US007907872B2

(12) United States Patent
Komatsu et al.

(10) Patent No.: US 7,907,872 B2
(45) Date of Patent: Mar. 15, 2011

(54) IMPRINTING APPARATUS AND AN IMAGE FORMATION APPARATUS

(75) Inventors: Makoto Komatsu, Kanagawa (JP); Hiroshi Koide, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 546 days.

(21) Appl. No.: 11/495,639

(22) Filed: Jul. 31, 2006

(65) Prior Publication Data

US 2007/0025768 A1 Feb. 1, 2007

(30) Foreign Application Priority Data

Jul. 29, 2005 (JP) ..... 2005-222076

(51) Int. Cl.
*G03G 15/00* (2006.01)

(52) U.S. Cl. ..... 399/167

(58) Field of Classification Search ..... 399/36, 399/37, 167

See application file for complete search history.

(56) References Cited

U.S. PATENT DOCUMENTS

| | | | | |
|---|---|---|---|---|
| 4,354,146 | A | 10/1982 | Tenmyo et al. | |
| 4,391,506 | A | 7/1983 | Koide | |
| 5,946,525 | A * | 8/1999 | Okamura et al. | 399/66 |
| 6,501,931 | B2 * | 12/2002 | Matsumoto | 399/167 |
| 6,507,713 | B2 | 1/2003 | Koide | |
| 6,760,559 | B2 | 7/2004 | Koide | |
| 6,771,919 | B2 | 8/2004 | Koide | |
| 6,868,244 | B2 | 3/2005 | Koide | |
| 6,889,030 | B2 | 5/2005 | Koide et al. | |
| 6,914,619 | B2 | 7/2005 | Koide | |
| 6,931,227 | B2 | 8/2005 | Koide | |
| 6,941,096 | B2 | 9/2005 | Matsuda et al. | |
| 6,949,896 | B2 | 9/2005 | Andoh et al. | |
| 6,996,357 | B2 | 2/2006 | Matsuda et al. | |
| 7,016,635 | B2 | 3/2006 | Koide | |
| 2004/0127317 | A1 | 7/2004 | Takuroh et al. | |
| 2004/0165915 | A1 * | 8/2004 | Hirai et al. | 399/302 |
| 2005/0099153 | A1 | 5/2005 | Komatsu et al. | |
| 2005/0111861 | A1 * | 5/2005 | Calamita et al. | 399/66 |
| 2005/0220491 | A1 | 10/2005 | Koide | |
| 2006/0088338 | A1 | 4/2006 | Matsuda et al. | |

FOREIGN PATENT DOCUMENTS

| | | | |
|---|---|---|---|
| JP | 59187334 A | * | 10/1984 |
| JP | 2001-265127 | | 9/2001 |

OTHER PUBLICATIONS

U.S. Appl. No. 11/141,639, filed Jun. 1, 2005, Hiromichi Matsuda, et al.

* cited by examiner

*Primary Examiner* — David M Gray
*Assistant Examiner* — Andrew V Do
(74) *Attorney, Agent, or Firm* — Oblon, Spivak, McClelland, Maier & Neustadt, L.L.P.

(57) ABSTRACT

An imprinting unit is disclosed where a driving current provided to a driving motor is temporarily increased from normal operations in sync with a shock generated when a recording medium enters and leaves a nip.

10 Claims, 32 Drawing Sheets

IMPRINTING APPARATUS AND AN IMAGE FORMATION APPARATUS

BACKGROUND OF THE INVENTION

1. Field of the Invention

The present invention relates to an image formation apparatus such as a color copying machine, a color printer, and a color facsimile that employ an image formation method such as an electrophotography method, an electrostatic recording method, and a magnetic recording method. The present invention further relates to a belt driving gear of a printing machine, and the like.

2. Description of the Related Art

Generally, an imprinting apparatus of an apparatus that requires imprinting, such as a copying machine, and a printing machine, for example, an electrostatic process copying machine, includes one of a photo conductor drum (drum) and a middle imprint object (belt), on which a toner image is formed, the drum (or the belt, as applicable) rotating at a predetermined speed, and a countering roller making forced contact with the drum (or the belt) and being pressed by a pressing member such as a spring. When a recording medium passes through a nip constituted by the drum (or the belt) and the countering roller, the toner image is imprinted onto the recording medium. With such a configuration, a transitional load fluctuation is generated at the drum (or the belt) due to a shock when the tip of the recording medium enters the nip and when the end of the recording medium departs from the nip because the thickness of the recording medium produces a level difference, and the rotational speed of the drum (or the belt) fluctuates.

Similar transitional load fluctuations are generated causing the rotational speed to fluctuate when the recording medium leaves conveyance rollers that convey the recording medium and when the recording medium enters fixing rollers by which the toner image is fixed on the recording medium.

The rotational speed fluctuation poses a problem in that image quality is degraded by a color shift, uneven coloring, etc. This problem is present not only with the electrostatic process copying machine, but also with other machines that imprint an image on the recording medium, such as a machine using a direct imprint method, where an image is directly imprinted on the recording medium from the photo conductor drum.

In an attempt to cope with the problem, there is an apparatus wherein an imprinting unit as a whole is made to rock. This is for reducing the amount of a shock transmitted at an image supporting object and a middle imprinting object without changing imprinting pressure, the shock being generated by the recording medium entering the imprinting apparatus (for example, Patent Reference 1). This proposed solution, however, enlarges dimensions of the apparatus because the rocking facility is provided. Furthermore, since the nip moves, an imprinting position moves, which generates a part where a period of receiving the imprinting pressure per unit length of an image is different from other parts. This causes the imprinting position to shift, posing a problem in that image concentration becomes uneven.

[Patent Reference 1] JPA 2001-265127

SUMMARY OF THE INVENTION

The present invention provides an imprinting apparatus and an image formation apparatus that substantially obviate one or more of the problems caused by the limitations and disadvantages of the related art.

Specifically, according to the imprinting apparatus of an embodiment of the present invention, one of a photo conductor drum (drum) and a middle imprint object (belt) for imprinting a toner image is driven by a stepping motor, either directly or geared-down, wherein a driving current for driving the stepping motor is controlled according to a transitional load fluctuation timing such that the transitional load fluctuation is mitigated. Further, the imprinting apparatus includes one of a flywheel, a member having a viscous property, and a member for transferring momentum (for moving shock energy to a movable member) such that the amount of the shock transmitted to the drum (or the belt, as applicable) is reduced, the shock being generated when the recording medium enters and departs from the nip, when the recording medium departs from a conveyance roller pair, and when the recording medium enters a fixing roller pair. Further, the amount of the shock transmitted to the recording medium, when directly imprinting, is reduced.

Features of the embodiment of the present invention are set forth in the description that follows, and in part will become apparent from the description and the accompanying drawings, or may be learned by practice of the invention according to the teachings provided in the description. Problem solutions provided by the embodiment of the present invention will be realized and attained by an imprinting apparatus and image formation apparatus particularly pointed out in the specification in such full, clear, concise, and exact terms as to enable a person having ordinary skill in the art to practice the invention.

To achieve these solutions and in accordance with an aspect of the invention, as embodied and broadly described herein, the embodiment of the invention provides an imprinting apparatus and image formation apparatus as follows.

Means for Solving the Problem

The imprinting apparatus for imprinting an image onto a recording medium when the recording medium passes a pressure-contacting nip according to the embodiment of the present invention includes:

a motor serving as a driving source;

an image supporting member driven by the motor; and a pressure-contacting member that includes at least a rotating body that contacts the image supporting member with pressure at the pressure-contacting nip; wherein a driving current supplied to the motor is temporarily increased with reference to a driving current during usual rotation when a transitional load fluctuation causing a transitional torque fluctuation occurs at one of the image supporting member and the rotating body by the recording medium entering and leaving the pressure-contacting nip such that an angle fluctuation of the motor becomes less than a predetermined threshold defined in view of quality of image with reference to a position fluctuation of images at a peak value of the transitional torque fluctuation.

Imprinting the image onto the recording medium can be carried out when the recording medium that is conveyed by a recording medium conveyance belt has pressing contact with the image supporting member.

The driving current is increased before the transitional load fluctuation occurs, and decreased after transitional load fluctuation.

The driving current is gradually increased and decreased such that a gap between images is less than an allowable threshold.

The driving current is increased at a timing determined based on a time lapse from a resist roller sending out the recording medium.

The timing may be determined based on a time lapse in receiving a signal from a detector for detecting the passage of the recording medium.

The timing may be determined with reference to a conversion table that contains a time difference vs. a length of the recording medium, where the length is included in a user's printing instruction.

The timing may be determined based on a time difference between detecting a tip and an end of the recording medium, as detected by the detector.

The embodiment of the present invention is applicable to a transitional load fluctuation generated by the recording medium entering a fixing unit that is provided downstream of the imprinting apparatus.

According to another aspect of the embodiment, the transitional load fluctuation is mitigated by providing a shock relief mechanism.

The shock relief mechanism can be a shock absorbing mechanism. Examples of shock absorbing mechanisms include an inertial mass unit, a spring mechanism, and a damping mechanism.

Two sets of shock absorbing mechanisms may be provided, one for a shock in a rotational direction and the other for a shock in the reverse direction.

The shock relief mechanism can be constituted by a flywheel member.

An auxiliary mechanism may be provided for mitigating a difference between rotational speeds of the flywheel member and the image supporting object (or the rotating body).

The motor can be one of an outer rotor type motor, a stepping motor, and an ultra sonic motor.

Where the image supporting member is a belt driven by a driving roller and one or more follower rollers, an encoder may be attached to at least one of the follower rollers such that a measurement result is fed back to the motor.

The embodiment also provides an image formation apparatus that employs the imprinting apparatus according to the present invention.

According to another aspect of the present invention, the transitional load fluctuation generated as various occasions as described above is mitigated by a shock relief mechanism.

The embodiment of the present invention offers an image formation apparatus that employs the imprinting apparatus wherein the transitional load fluctuation is mitigated by the shock relief mechanism.

EFFECT OF THE INVENTION

According to the imprinting apparatus of the embodiment of the present invention, even if a transitional load fluctuation occurs due to the recording medium entering and/or leaving a unit in the conveyance pass, such as the nip, influence of the transitional load fluctuation is mitigated and a stable and precise image is obtained.

DESCRIPTION OF THE PREFERRED EMBODIMENTS

In the following, embodiments of the present invention are described with reference to the accompanying drawings.

Figure 1:
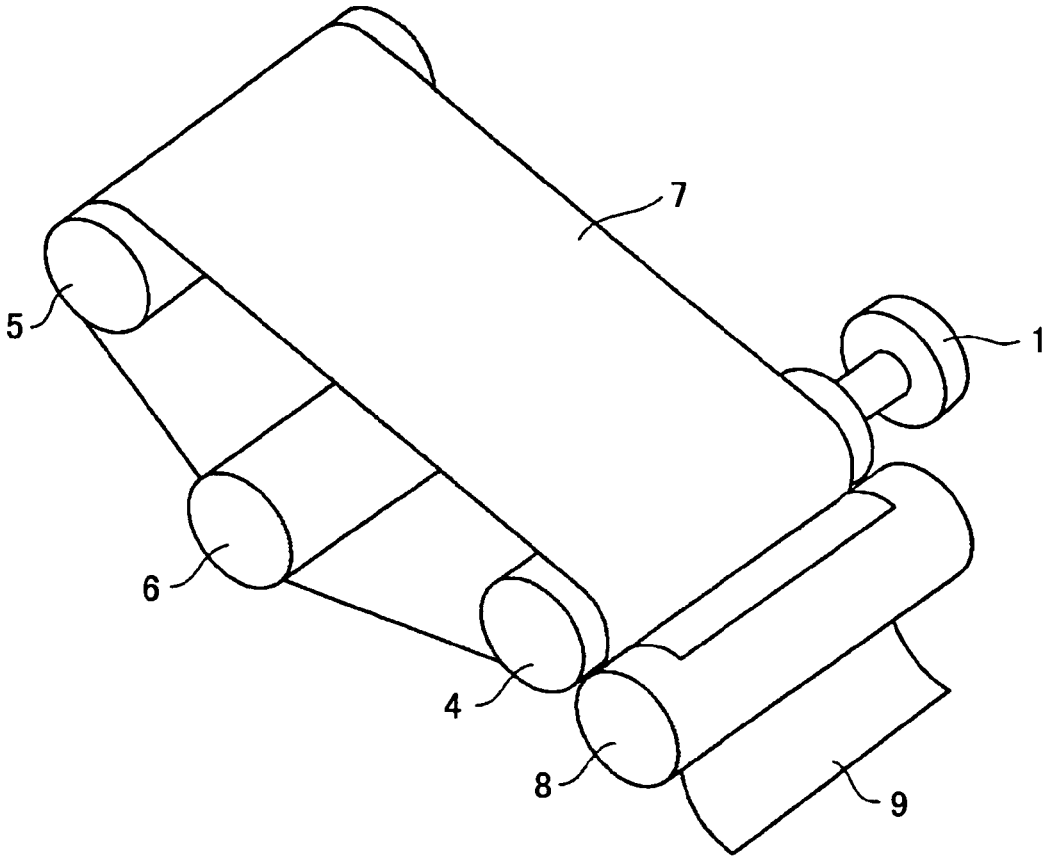
FIG. 1 is a perspective view showing an example of an imprinting apparatus that is a belt type (belt type imprinting apparatus) according to the present invention.

FIG. 1 shows an example of a belt type imprinting apparatus to which an embodiment of the present invention is applied.

The belt type imprinting apparatus includes a stepping motor 1, a driving roller 4, follower rollers 5 and 6, an imprint belt 7, a countering roller 8, and a recording medium (imprint paper) 9.

The stepping motor 1 and the driving roller 4 are concentrically arranged, where the stepping motor 1 directly drives the driving roller 4. The imprint belt 7 is wound around the driving roller 4 and the follower rollers 5 and 6. Here, a toner image is produced on the imprint belt 7 by an imaging unit that is not illustrated. Further, the countering roller 8 is in pressing contact with the driving roller 4 serving as a pressure-contacting member, and the toner image on the imprint belt 7 is imprinted on the recording medium 9 when the recording medium 9 passes through a pressure-contacting nip formed by the driving roller 4 and the countering roller 8.

Figure 2:
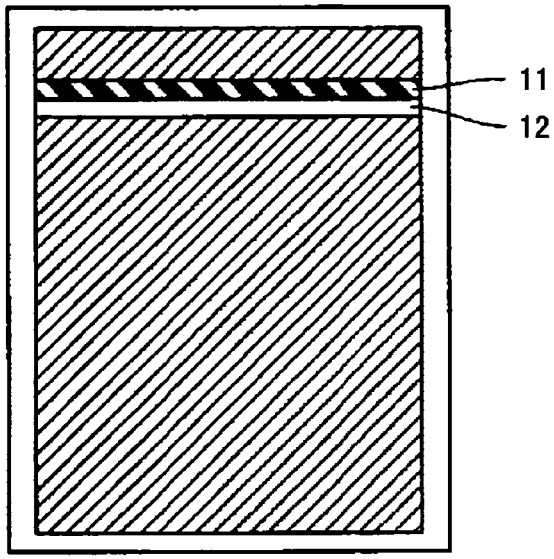
FIG. 2 is a plan view for explaining image unevenness in the shape a stripe produced on a recording medium.

FIG. 2 shows image unevenness in the shape of a stripe produced on the recording medium 9.

In FIG. 2, a black stripe 11 and a white stripe 12 are shown.

When the recording medium 9 enters and departs from the pressure-contacting nip, a mechanical shock is generated, causing a transitional load fluctuation to occur. The shock is generated for various reasons such as the recording medium 9 hitting the driving roller 4, the imprint belt 7, and the countering roller 8; and widening and narrowing the pressure-contacting nip (nip) by the thickness of the recording medium 9 when the recording medium 9 enters and departs from the pressure-contacting unit (nip). Here, the shock is transmitted to the driving roller through the imprint belt. In the case wherein two or more sheets of the recording medium are continuously processed, the transitional load fluctuation can occur when a toner image is being imprinted onto the middle imprint belt 7 from the photo conductor drum, causing the rotational speed of the driving roller 4 to fluctuate. The speed fluctuation influences the rotational drive of the middle imprint belt 7. For example, if an image of solid black of 50% concentration is output, the black stripe 11 and the white stripe 12 are produced on the same sheet when forming an image that is long in a direction of the imprint belt, or on a following sheet when forming an image that is short.

Figure 28:
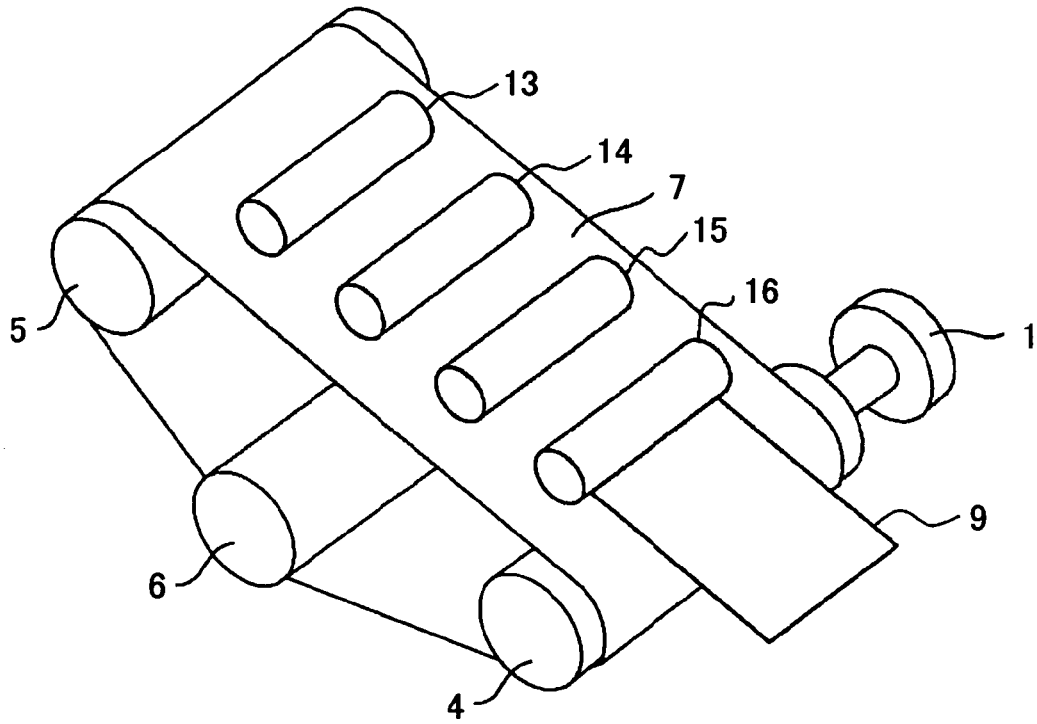
FIG. 28 is a perspective view showing an example of the belt type imprinting apparatus to which an embodiment of the present invention is applied.

FIG. 28 shows an example of the belt type imprinting apparatus, to which an embodiment of the present invention is applied.

The belt type imprinting apparatus shown in FIG. 28 includes photo conductor drums 13 through 16 for corresponding colors. As for items with other reference numbers, descriptions given above are referred to; and this rule applies to the following descriptions.

That is, this belt type imprinting apparatus includes the stepping motor 1 that directly drives the driving roller 4, and the conveyance belt 7 is wound around the driving roller 4 and the follower rollers 5 and 6, which is the same as shown by FIG. 1. The photo conductor drums 13, 14, 15, and 16 are arranged such that they contact the imprint belt 7. The recording medium 9 is conveyed between the imprint belt 7 and each of the photo conductor drums 13, 14, 15, and 16 such that the toner images on the photo conductor drums 13, 14, and 15 and 16 are directly imprinted onto the recording medium 9.

When sheets of the recording medium 9 are continuously provided for conveyance, a transitional load fluctuation occurs due to a shock produced by the recording medium 9 entering and departing from the nip. The transitional load fluctuation can be due to the recording medium 9 hitting the photo conductor drums 13, 14, 15, and 16 and the conveyance belt 7, the nip being widened by the thickness of the recording medium 9 when entering, and the nip being narrowed by the thickness of the recording medium 9 when departing. For this reason, the black stripe 11 and the white stripe 12 as shown in FIG. 2 are generated.

Further, in the case of an image formation apparatus wherein color pixels are formed on the imprint belt by piling up toner images that are formed on the four photo conductor drums in each of the four colors, when the transitional load fluctuation is generated, pixels that are affected by the transitional load fluctuation and pixels that are not affected by the transitional load fluctuation are piled up on the imprint belt, causing a color shift.

Figure 29:
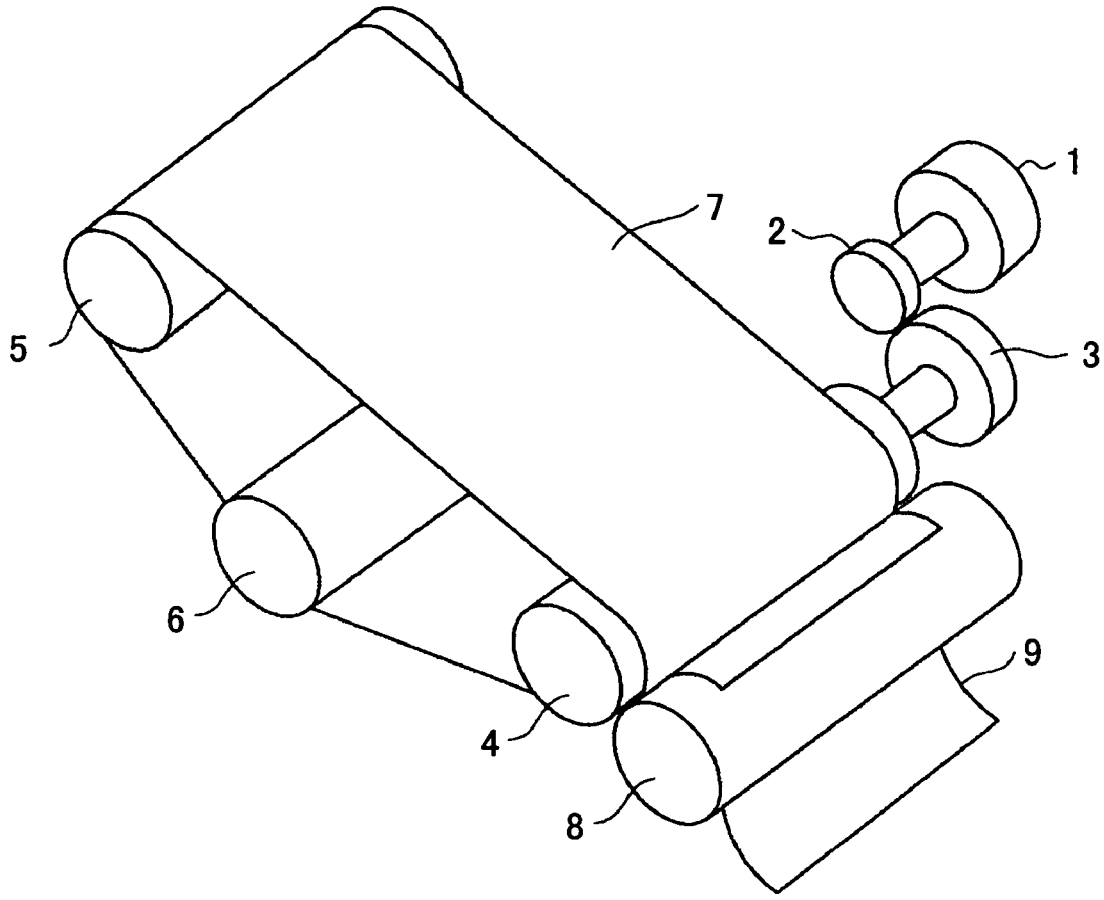
FIG. 29 is a perspective view showing another example of the belt type imprinting apparatus to which an embodiment of the present invention is applied.
Figure 30:
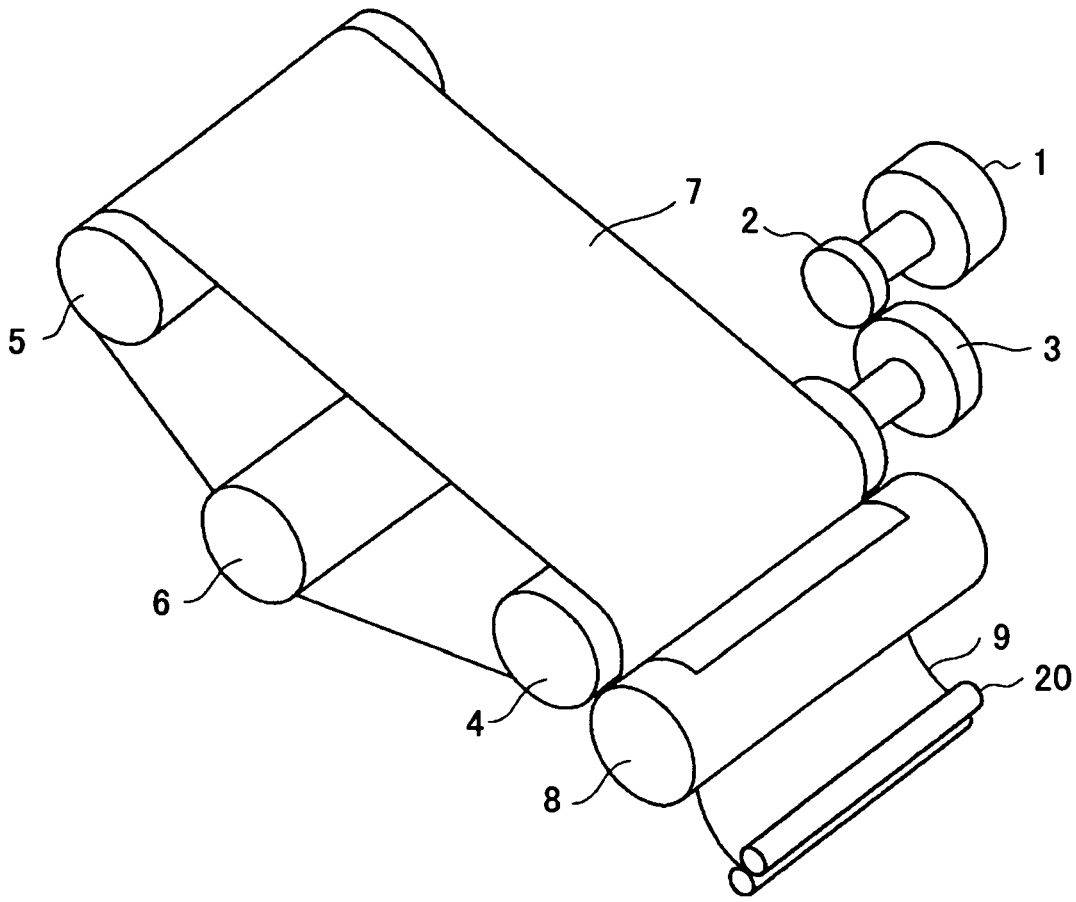
FIG. 30 is a perspective view showing another example of the belt type imprinting apparatus to which an embodiment of the present invention is applied.
Figure 31:
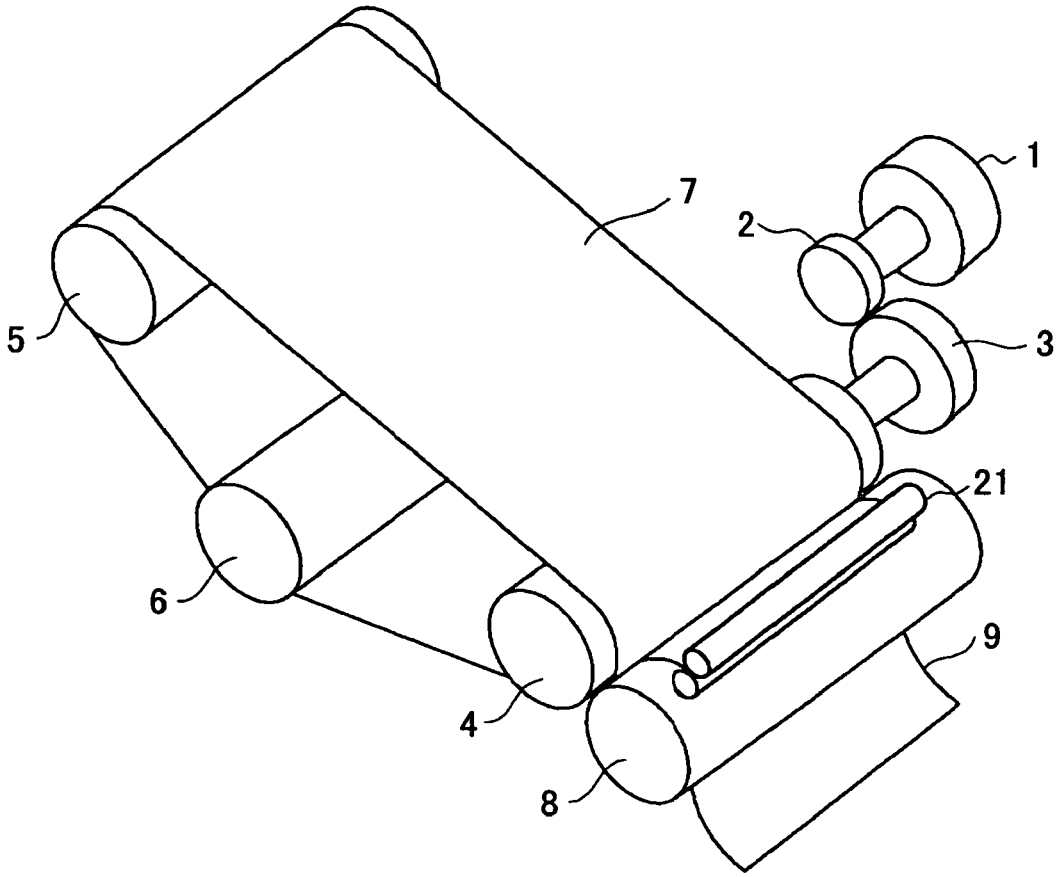
FIG. 31 is a perspective view showing another example of the belt type imprinting apparatus to which an embodiment of the present invention is applied.

FIGS. 29, 30, and 31 show other examples of the belt type imprinting apparatus to which an embodiment of the present invention is applied.

In FIGS. 29, 30, and 31, each belt type imprinting apparatus includes a driving gear 2, a follower gear 3, a resist roller pair 20, and a fixing roller pair 21.

First, items that are common through FIGS. 29, 30, and 31 are described.

The driving gear 2 and the stepping motor 1, which is the driving source, are concentrically arranged. Further, the follower gear 3 and the driving roller 4 are concentrically arranged. The driving gear 2 is in meshing engagement with the follower gear 3 such that the drive of the stepping motor 1 is transmitted to the driving roller 4. The imprint belt 7 is wound around the driving roller 4, the follower rollers 5, and 6. Toner images are imprinted on the imprint belt 7 by the photo conductor drums that are not illustrated here. Further, the countering roller 8 and the driving roller 4 make forced contact, and the toner images on the imprint belt 7 are imprinted on the recording medium 9 as the recording medium 9 passes through the nip formed by the driving roller 4 and the countering roller 8.

With the configuration of FIG. 29, when the recording medium is fed, the transitional load fluctuation occurs due to the shock due to the recording medium entering and departing from the nip. The transitional load fluctuation is considered to occur when the recording medium 9 hits the driving roller 4, the imprint belt 7, and the countering roller 8; when the nip is widened by the thickness of the recording medium 9; and when the recording medium 9 departs from the nip. Here, the shock is transmitted to the driving roller 4 through the imprint belt 7. If the recording medium is continuously fed, since subsequent toner images are imprinted from the photo conductor drums (not illustrated here) onto the middle imprint belt 7, the transitional load fluctuation causes the rotation speed of the driving roller 4 to change, the speed change is transmitted to the middle imprint belt 7, and imprinting of subsequent toner images is disturbed.

According to the configuration of FIG. 30, the recording medium 9 is conveyed to the nip by a resist roller pair 20. In this case, a transitional load fluctuation occurs due to a difference of the conveyance speed of the recording medium 9 when the recording medium 9 leaves the resist roller pair 20. The load fluctuation is transmitted to the nip by the recording medium 9, and is further transmitted to the imprint belt 7 through the driving roller 4. Furthermore, FIG. 31 illustrates the configuration wherein the recording medium 9 passes through the nip and reaches a fixing roller pair 21. When the recording medium 9 hits the fixing roller pair 21, a transitional load fluctuation due to the hit occurs. The transitional load fluctuation leads to degradation of image quality.

According to the embodiments, in order to reduce influence of the transitional load fluctuation, torque generated by the stepping motor 1 is increased corresponding to the transitional load fluctuation, and a member including a flywheel with a function to dampen the shock and vibration due to the transitional load fluctuation is provided. The transitional load fluctuation is generated when the recording medium passes through the nip formed by the driving roller 4 and the countering roller 8, leaves the resist roller pair 20, and enters the fixing roller pair 21, wherein the drive of the stepping motor is transmitted through a gear-down mechanism and the angular velocity of the driving roller is controlled.

Figure 32:
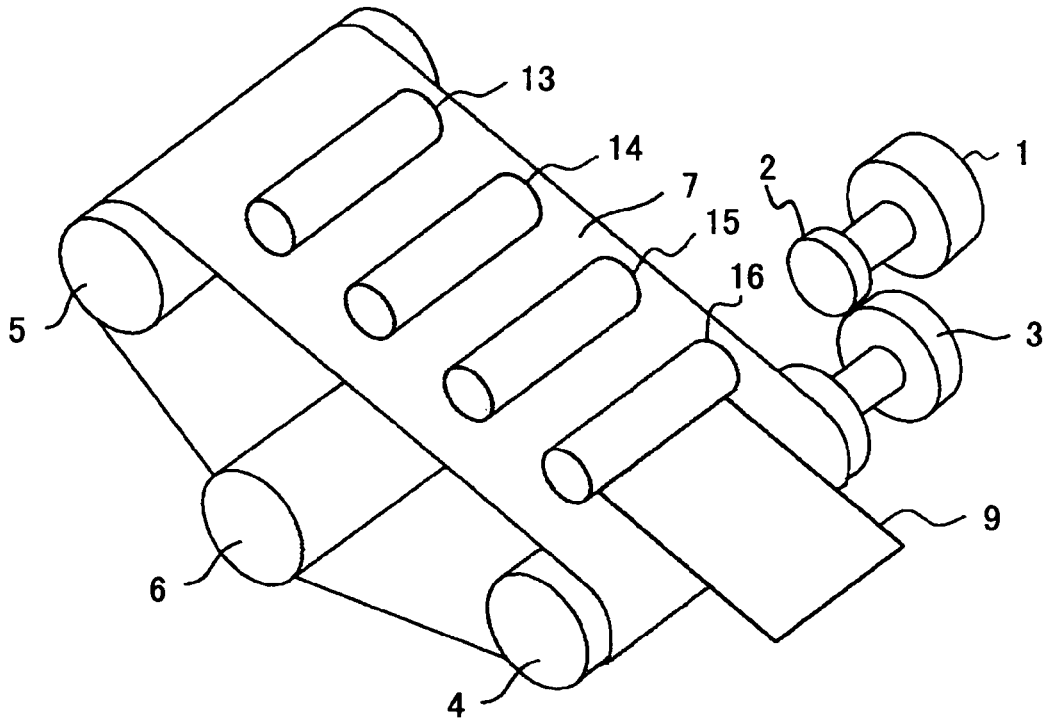
FIG. 32 is a perspective view showing another example of the belt type imprinting apparatus to which an embodiment of the present invention is applied.
Figure 33:
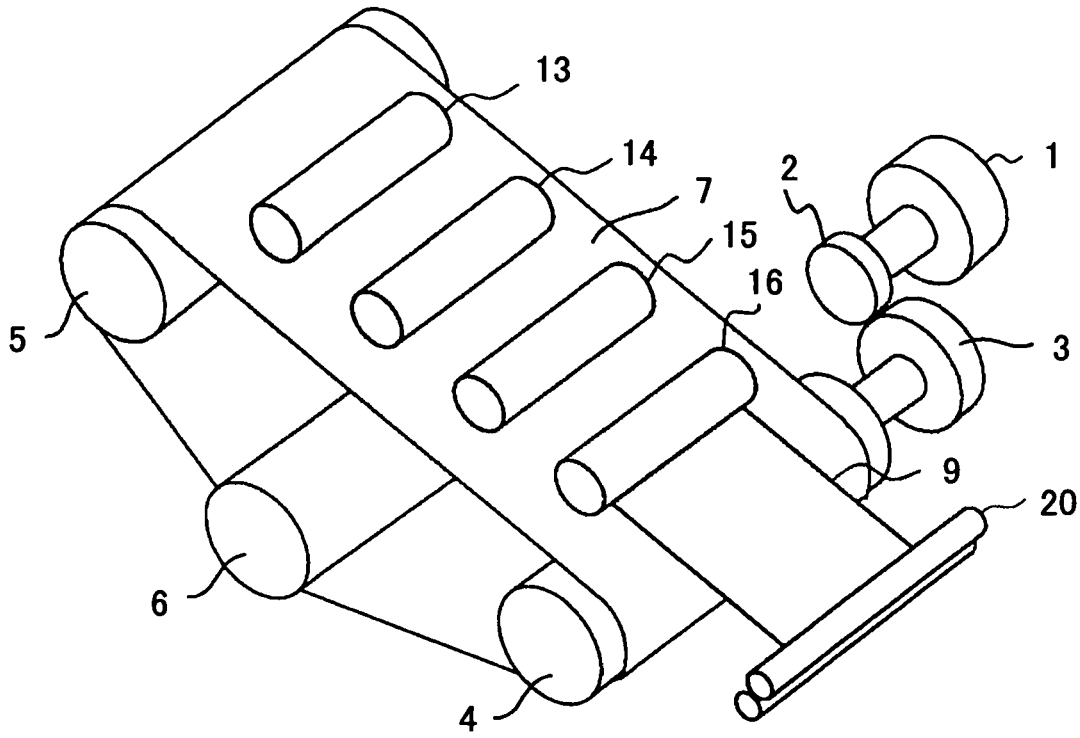
FIG. 33 is a perspective view showing another example of the belt type imprinting apparatus to which an embodiment of the present invention is applied.
Figure 34:
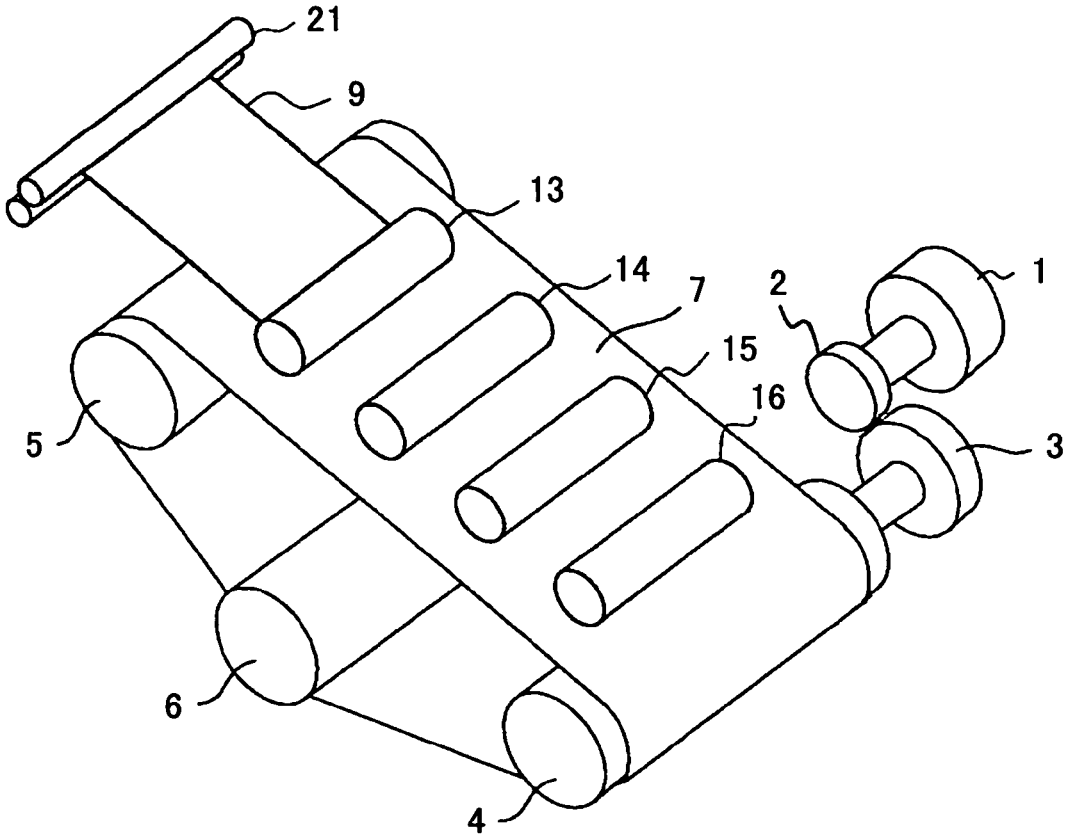
FIG. 34 is a perspective view showing another example of the belt type imprinting apparatus to which an embodiment of the present invention is applied.

FIGS. 32, 33, and 34 show additional examples of the belt type imprinting apparatus, to which an embodiment of the present invention is applied.

Common members in each of the drawings are described.

The driving gear 2 is concentrically arranged with the stepping motor 1, which is the driving source. The follower gear 3 is concentrically arranged with the driving roller 4. The driving gear 2 is in meshing engagement with the follower gear 3 such that the drive of the stepping motor 1 is transmitted to the driving roller 4. The conveyance belt 7 is wound around the driving roller 4, and the follower rollers 5 and 6. The four photo conductor drums 13, 14, 15, and 16 are arranged contacting the conveyance belt 7. The recording medium 9 is conveyed between the conveyance belt 7 and the photo conductor drums 13, 14, 15, and 16. The toner images on the photo conductor drums 13, 14, 15, and 16 are directly imprinted onto the recording medium 9.

With the configuration of FIG. 32, when the recording medium is fed, the transitional load fluctuation is generated by a shock when the recording medium enters and departs from the nip. The transitional load fluctuation is considered to occur when the recording medium 9 hits the photo conductor drums 13, 14, 15, 16, and the conveyance belt 7; when the nip is widened by the thickness of the recording medium 9; and when the recording medium 9 departs from the nip. When the recording medium is fed, the transitional load fluctuation occurs, and change arises on the conveyance belt 7 and the recording medium 9 when toner images are imprinted from the photo conductor drums onto the recording medium 9.

According to the configuration of FIG. 33, the recording medium 9 is conveyed to the nip by the resist roller pair 20. In this case, when the recording medium 9 leaves the resist roller pair 20, a transitional load fluctuation occurs due to the difference of the conveyance speed of the recording medium 9, etc. The transitional load fluctuation is transmitted to the nip by the recording medium 9, and is further transmitted to the imprint belt 7 through the driving roller 4. Further, FIG. 34 shows where the recording medium 9 reaches the fixing roller pair 21. When the recording medium 9 enters the fixing roller pair 21, the transitional load fluctuation occurs. The transitional load fluctuation leads to degradation of image quality.

As described above, a mechanism for uniformly moving the imprint belt includes a DC motor or a stepping motor that either directly or indirectly drives the driving roller. The indirect drive is attained by using a transfer mechanism such as gears. Here, it is often the practice that one of a rotation angle detector and an angular velocity detector, such as a rotational encoder, is concentrically arranged with the motor, the driving roller and/or the follower roller; and a detection result (detection signal) of the detector is fed back for controlling. Especially, when the rotation angle detector or the angular velocity detector, such as the rotational encoder, is concentrically arranged with the follower roller, slippage between the driving roller and the imprint belt is mitigated. Further, it is also the practice that the driving roller is driven by the stepping motor without using feedback.

Here, feedback control is described with reference to FIG. 3 wherein the rotation angle detector or the angular velocity detector such as the encoder is used for feedback-controlling the speed of the imprint belt 7 of FIG. 1 with the stepping motor.

Figure 3:
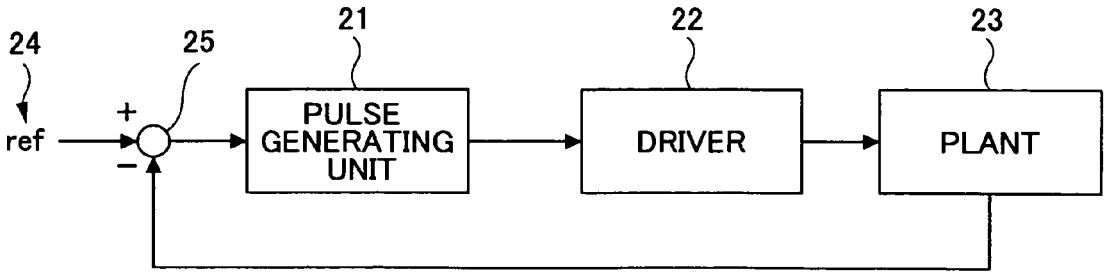
FIG. 3 is a block diagram of driving an imprint belt with a stepping motor.

FIG. 3 is a block diagram of a feedback control unit for controlling the drive of the imprint belt with the stepping motor. The feedback control unit includes a pulse generating unit 21, a driver 22, a plant 23 that includes a rotating system, and a subtractor 25. A target value 24 of the rotation angle (or rotation angular velocity, as applicable) is provided to the subtractor 25.

The pulse generating unit 21 generates a pulse that determines the driving speed of the stepping motor. The pulse is provided to the driver 22, which driver 22 provides an electric current to a coil of the stepping motor for rotating in sync with the pulse. If the motor is, for example, a three phase stepping motor, the current is provided to one or more selected coils that are either Y-connected or delta-connected. The plant 23 provides two or more lead lines for electrically connecting the coils and the driver 22. The plant 23 is a system constituted by such as the stepping motor, the imprint belt that is the target to drive, rotating bodies such as the driving roller and the follower roller(s), and a rotational encoder. In order to measure the speed of the imprint belt, the rotational encoder attached to, e.g., the follower roller measures a rotation angle (or rotation angular velocity, as applicable), and the measured value is fed back to the subtractor 25. The subtractor 25 compares the target value 24 with the measured value that is fed back. The target value 24 represents a rotation angle (or rotation angular velocity) of the rotational encoder corresponding to a target belt speed. A result of the comparison is provided to the pulse generating unit, wherein the frequency of the pulse is controlled based on the result. That is, if the belt speed is lower than the target, the frequency of the pulse is increased. If the belt speed is higher than the target, the pulse frequency is reduced.

Figure 4A:
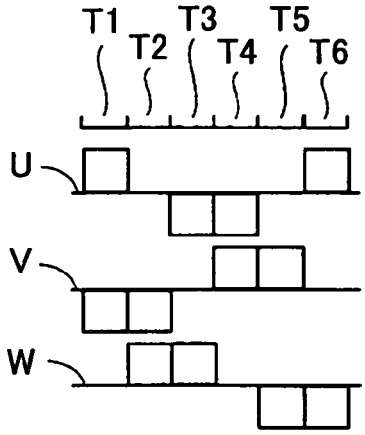
FIG. 4A is a timing chart of a three phase stepping motor.
Figure 4B:
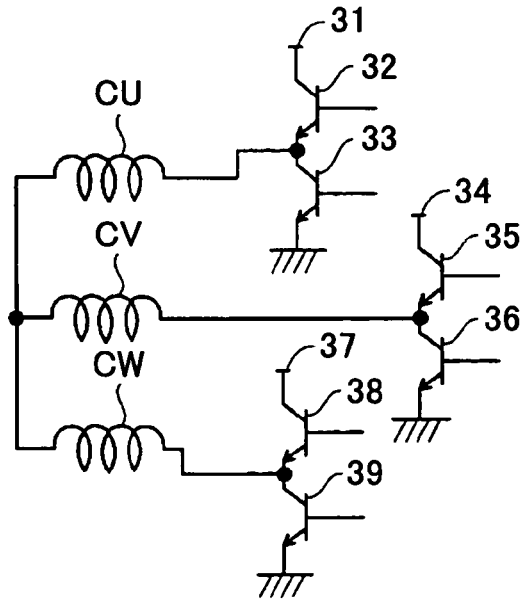
FIG. 4B and FIG. 4C are circuit diagrams showing a driving unit for the three phase stepping motors.
Figure 4C:
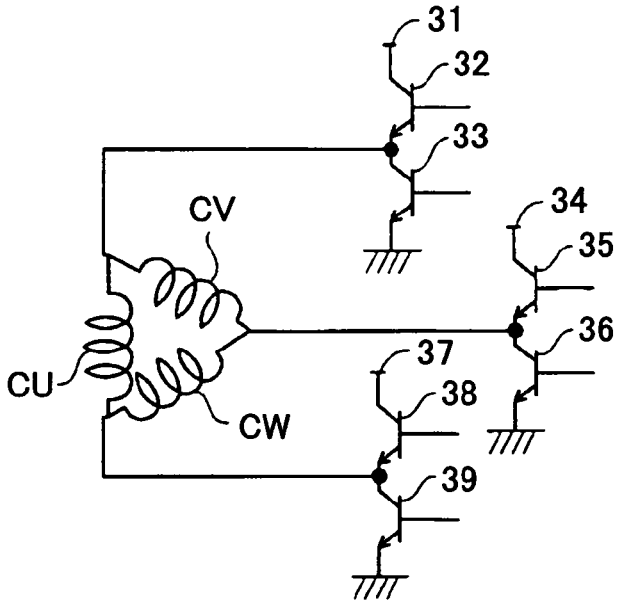

FIG. 4A is a timing chart of the three-phase stepping motor. FIG. 4B and FIG. 4C are circuit diagrams showing driving circuits of the three-phase stepping motor of delta connection and Y-connection, respectively.

The driving circuit includes input terminals 31, 34, and 37 for each phase; and switching transistors 32, 33, 35, 36, 38, and 39. Further, U, V and W indicate the three phases that are 120 degrees shifted from each other.

That is, the three phases of the stepping motor are called U phase, V phase, and W phase. In the timing chart given by FIG. 4A, the currents provided to the corresponding coils are expressed by U, V, and W, respectively. Further, with reference to FIG. 4A, the vertical axis of U, V, and W represents a direction of magnetic flux of the corresponding coils. That is, the polarity of excitation is reversed with a centerline bordering an upper part and a lower part; that is, the direction of the electric current flowing in the coil is reversed. Furthermore, the upper horizontal axis represents the passage of time from left to right. The time is divided into timings T1 through T6.

With reference to FIG. 4B, the drive circuit employs a Y connection and uses six switching transistors 32, 33, 35, 36, 38, and 39, wherein the input terminals 31, 34, and 37 are connected to the power supply. Here, coils CU, CV, and CW represent the corresponding phases of the motor coils, namely, U phase, V phase, and W phase, respectively. Operations of the Y-connected drive circuit are described according to the timing shown by FIG. 4A. At timings T1, U and V are excited by mutually opposite polarities. At this time, the switching transistors 32 and 36 of FIG. 4B are turned on. Then, a current flows from the input terminal 31 connected to the power supply to ground through the switching transistor 32, CU, CV, and the switching transistor 36 so that the coils CU and CV are excited.

Next, at a timing T2, the switching transistors 38 and 36 are turned on. Then, the current flows from the input terminal 37 to ground through the switching transistor 36, CW, CV, and the switching transistor 38 so that the coils CW and CV are excited.

Next, at a timing T3, the switching transistors 38 and 33 are turned on. Then, the current flows from the input terminal 37 to ground through the switching transistor 33, CW, CU, and the switching transistor 38 so that the coils CW and CU are excited.

Next, at a timing T4, the switching transistors 35 and 33 are turned on. Then, the current flows from the input terminal 34 to ground through the switching transistor 33, CV, CU, and the switching transistor 35 so that the coils V and U are excited.

Next, at a timing T5, the switching transistors 35 and 39 are turned on. Then, the current flows from the input terminal 34 to ground through the switching transistor 39, CV, CW, and the switching transistor 35 so that the coils V and W are excited.

Next, at a timing T6, the switching transistors 32 and 39 are turned. Then, the current flows from the input terminal 37 to ground through the switching transistor 39, CU, CW, and the switching transistor 32 so that the coils CU and CW are excited.

Through the steps of the timings T1 through T6, the rotor of the three phase stepping motor is advanced one tooth pitch. The stepping motor is rotated by repeating the steps described above.

With reference to FIG. 4C, the drive circuit is for the delta connection, includes the input terminals 31, 34, and 37 connected to the power supply, and the switching transistors 32, 33, 35, 36, 38, and 39. Further, the coils CU, CV, and CW represent the three phases of the motor coil, namely, U phase, V phase, and W phase, respectively.

While the stepping motor is driven by the drive circuit, in the case of the delta connection, all the three phases are excited at a given time.

First, at the timing T1, the switching transistors 32 and 36 are turned on. Then, the coil CV is excited as one phase; and the coils CU and CW are excited in two phases (phase sequence). The coils CU and CW that are connected in series are parallel to the coil CV. Although all three phases are excited, amounts of excitation are different.

Next, at the timing T2, the switching transistors 38 and 36 are turned on. Then, the coil CW is excited as one phase; and the coils CV and CU are excited in two phases (phase sequence). The coils CV and CU that are connected in series are parallel to the coil CW. Although all three phases are excited, the amounts of excitation are different.

Next, at the timing T3, the switching transistors 38 and 33 are turned on. Then, the coil CU is excited as one phase; and the coils CV and CW are excited in two phases (phase sequence). The coils CV and CW that are connected in series are paralleled by the coil CU. Although all three phases are excited, the amounts of excitation are different.

Next, at the timing T4, the switching transistors 35 and 33 are turned on. Then, the coil CV is excited as one phase; and the coils CU and CW are excited in two phases (phase sequence). The coils CU and CW that are connected in series are parallel to the coil CV. Although all three phases are excited, the amounts of excitation are different. Here, the directions of the excitation differ from the timing T1 when the switching transistors 32 and 36 are turned on.

Next, at the timing T5, the switching transistors 35 and 39 are turned on. Then, the coil CW is excited as one phase; and the coils CV and CU are excited in two phases (phase sequence). The coils CV and CU that are connected in series are parallel to the coil CW. Although all three phases are excited, the amounts of excitation are different. Here, the directions of the excitation differ from the timing T2 when the switching transistors 38 and 36 are turned on.

Next, at the timing T6, the switching transistors 32 and 39 are turned on. The coils CU is excited as one phase; and the coils CV and CW are excited in two phases (phase sequence). The coils CV and CW that are connected in series are parallel to the coil CU. Although all three phases are excited, the amounts of excitation are different. Here, the directions of the excitation differ from the timing T3 when the switching transistors 38 and 33 are turned on.

Through the steps of the timings T1 through T6, the rotor of the stepping motor is advanced one tooth pitch. The stepping motor is rotated by repeating the steps described above.

Here, the feedback control of the drive is carried out for reducing the transitional load fluctuation generated in the imprint nip as described above, i.e., after the transitional load fluctuation occurs. Accordingly, compensation for a transitional angular velocity change of the driving roller cannot be performed in time, given that the feedback control contains various time delay elements.

For example, in the case of the rotational encoder, timing marks are concentrically prepared at equal intervals on a glass disk with the rotational axle of the glass disk being at the center. The glass disk is concentrically arranged with a roller, the rotation angle (or rotation angular velocity) of which is to be measured. The rotation angle (or rotation angular velocity) is optically measured using a luminous source and an optical receiving unit that are arranged to a fixed member. The output of the optical receiving unit is a continuous pulse train. That is, information of the rotation angle (or rotation angular velocity) is discrete; this generates a time delay. Further, a rotation change generated by the transitional load fluctuation is detected by a change of the pulse train, and the pulse frequency for driving the stepping motor is adjusted; this generates another time delay.

The discussion presented above also applies to a DC motor. That is, the time delay occurs with the rotational encoder. Further, when detecting the rotation change due to the transitional load fluctuation using the information from the rotational encoder, and when carrying out the feedback control, adjusting the drive is delayed. This is due to a time delay caused by a phase compensating network, and a delayed rise time of a current wave form due to counter-electromotive force and an internal inductance of the DC motor.

According to the embodiments of the present invention, when a transitional load fluctuation occurs, the rotation angle change of the stepping motor is reduced to a degree that quality-of-image degradation is not conspicuous.

If the driving roller is driven by the stepping motor without feedback and without the devices of the embodiments of the present invention, a rotation change of the driving roller due to the transitional load fluctuation when the recording medium passes through the imprint unit degrades the quality-of-image.

Figure 5A:
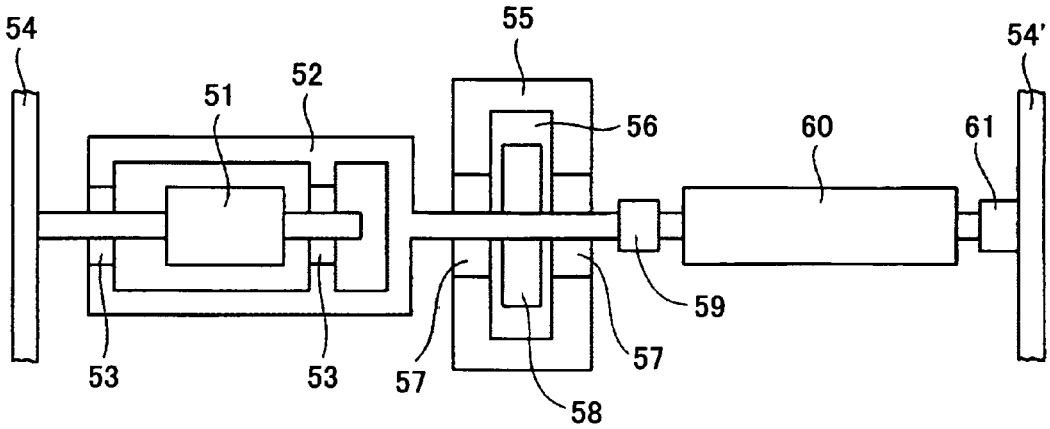
FIG. 5A and FIG. 5B are schematic diagrams for explaining Embodiment 1 of the present invention.
Figure 5B:
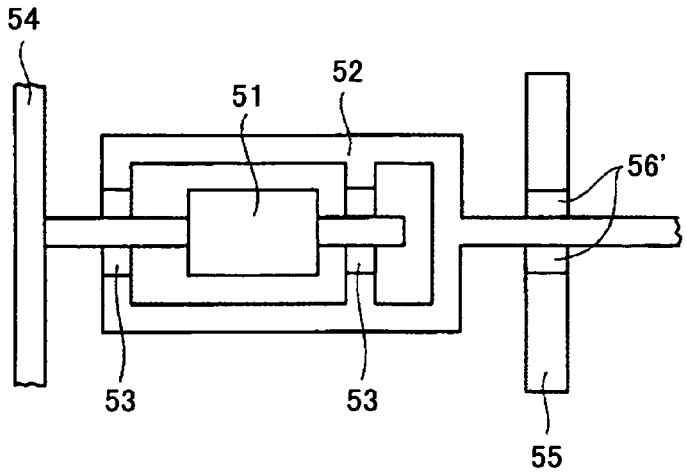

Embodiment 1 of the present invention is described with reference to FIG. 5A showing a flywheel 55 in the shape of a container, and FIG. 5B showing the flywheel 55 fixed to an axle through an elastic body. The flywheel 55 constitutes a flywheel assembly.

The flywheel assembly includes a stator 51, an outer rotor 52, an outer roller bearing 53, side plates 54 and 54', the flywheel 55, a viscosity member 56, an elastic member 56', a bearing 57, a rotating member 58, a universal joint 59, a driving roller 60, and a bearing 61.

According to Embodiment 1, the rotation change of the driving roller is reduced by increasing the torque of the stepping motor corresponding to occurrence of the transitional load fluctuation when the stepping motor drives the driving roller at a controlled rotational angular velocity in order to reduce the rotation change of the driving roller due to the transitional load fluctuation generated by the recording medium passing the nip constituted by the driving roller 4 and the countering roller 8.

Further, the rotation change is reduced by the flywheel assembly for dumping the shock and vibration due to the transitional load fluctuation.

According to Embodiment 1, the stepping motor, which is a driving source, is of an outer rotor configuration. Comparing the outer rotor stepping motor with an inner rotor stepping motor, the former has a higher moment of inertia of the rotor providing stable rotation even when there is a high-frequency vibration, and an improved flywheel effect of reducing a peak of the transitional load fluctuation in the rotation direction. Further, in the case of the inner rotor stepping motor, since a coil is wound around a stator, the stator with the coil is placed on the outside. That is, a smaller space is available for the rotor, and only a smaller torque is obtained as compared with the outer rotor stepping motor. In other words, for the same driving current, the outer rotor stepping motor can provide a greater driving torque, and is more capable of coping with the transitional load fluctuation. Since the torque is generally proportional to $D^2L$, where D is the rotor diameter and L is the rotor length in the axle direction, the greater the rotor diameter D is, the greater the torque is. For the same dimensions of the stepping motor, the outer rotor stepping motor can provide the greater torque.

Furthermore, when the stepping motor directly drives the driving roller, a load fluctuation (described below) can be reduced by providing a great number of teeth to the stepping motor. Given that the greater the diameter is, the greater is the number of teeth that can be provided to the outer rotor stepping motor, mechanical resolution can be raised with the outer rotor stepping motor. Here, the resolution can be raised in appearance by providing a mechanism wherein the rotational speed is increased not with gears but with a roller. In this case, however, in order to reduce belt slippage, a device to increase friction of the roller surface is required.

With reference to FIG. 5A, the stator 51 is arranged and fixed to an axle that is fixed to the side plate 54 that is fixed to the image formation apparatus.

The outer rotor 52 is supported by the outer roller bearing 53 placed on the axle that is fixed to the side plate 54, and the outer rotor 52 is rotated by a rotating magnetic field generated by the stator 51. The outer rotor 52 is fixed to one end of the driving roller 60 through the universal joint 59 arranged on the axle of the motor rotation, the universal joint 59 rotating with the outer rotor 52. The other end of the driving roller 60 is supported by the bearing 61 that is fixed to the side plate 54' that counters the side plate 54.

Further, the flywheel 55 in the shape of the container is arranged on the axle of the motor rotation of the outer rotor 52 being supported by the bearing 57 and a rotating member 58 that rotates with the axle of the motor rotation. The rotating member 58 is installed inside the container formed by the flywheel 55. A space between the rotating member 58 and the flywheel 55 is filled with a viscosity member 56 such as silicon. The rotating member 58 and the viscosity member 56 serve as an auxiliary mechanism (a shock relief mechanism) for reducing a difference between the flywheel 55 and a rotating body that is subject to a transitional torque fluctuation. Namely, while the driving roller 60 is rotated at a constant rotational speed, the rotating member 58 is rotated at the constant rotational speed. When a shock (transitional load fluctuation) is generated by the recording medium entering the pressure-contacting nip, for example, as formed by the driving roller 4 and the countering roller 8 as shown in FIG. 1, the rotational speed of the rotating member 58, which rotational speed is the same as that of the driving roller 60, fluctuates. On the other hand, the flywheel 55 tends to maintain constant speed because of its great moment of inertia. Accordingly, a relative velocity (difference in rotational speed) is generated between the rotating member 58 and the flywheel 55. Here, the viscosity member 56 (a dumping effect thereof) reduces the amount of the relative velocity. As a result, a peak value of the transitional rotation change is reduced. Further, the auxiliary mechanism (the shock relief mechanism) constituted by the flywheel 55, the viscosity member 56, the bearing 57, and the rotating member 58 reduces vibration of the stepping motor.

The auxiliary mechanism (the shock relief mechanism) for improving dumping of the stepping motor can be configured as shown FIG. 5B. The stepping motor serving as the driving source here also is the outer rotor type configuration. The stator 51 is arranged and fixed to an axle that is fixed to the side plate 54 that is fixed to the image formation apparatus. The outer rotor 52 is supported by the outer roller bearing 53 placed on the axle that is fixed to the side plate 54, and is rotated by the rotating magnetic field generated by the stator 51. Further, the flywheel 55 is arranged on the rotation axle of the motor through an elastic member 56' made of such as rubber, the elastic member 56' serving as the auxiliary mechanism (the shock relief mechanism). The rotation axle of the motor rotates in one body with the outer rotor 52.

By the configuration as described above, when a shock (transitional load fluctuation) is generated by the recording medium entering the pressure-contacting nip formed by the driving roller 4 and the countering roller 8 as shown in FIG. 1, since the flywheel 55 has moment of inertia and it is freely rotating, the flywheel 55 tends to maintain the rotational speed. However, a motion of the flywheel 55 is delayed by the elastic member 56'. An oscillating phase difference, which is the delay of the motion of the flywheel 55 with reference to the rotation axle of the motor, controls the rotation axle of the motor. As a result, the peak value of the transitional rotation change is reduced. Furthermore, the auxiliary mechanism (the shock relief mechanism) constituted by the flywheel 55 and the elastic member 56' reduces a vibration of the stepping motor.

Figure 6:
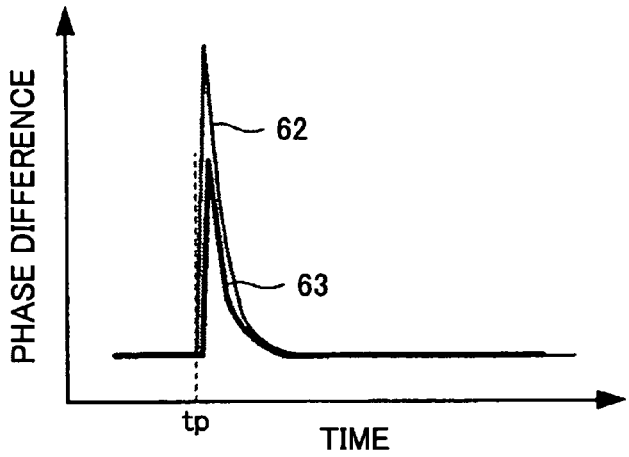
FIG. 6 is a graph showing a phase difference produced in a motor due to a difference in moment of inertia.

FIG. 6 shows a difference in the phase differences generated by the motor due to the difference in the moments of inertia.

A curve 62 expresses the phase difference by the moment of inertia in a usual basic configuration, and a curve 63 expresses the same where the amount of the moment of inertia is doubled.

A brief description follows concerning a peak value of the phase difference being reduced by increasing the moment of inertia with a flywheel. A simplified model for obtaining a transient response property while rotating at a constant speed is supposed as follows.

$$J\frac{d^2\theta}{dt^2} + D\frac{d\theta}{dt} + k\theta = T_d \qquad \text{[Equation 1]}$$

Here, in this formula, J is an amount of moment of inertia, D is a damping coefficient in the rotation direction, k is a torque required for moving a unit angle, θ is a phase difference between countering teeth of the stepping motor, and Td is an amount of a shock torque (assumed to be a single square wave). The curves 62 and 63 were obtained with a simulation including the formula, wherein the phase difference is obtained with only the moment of inertia being changed, normalized values of which moment of inertia are 1 and 2, and with other values being fixed. The single square wave serving as the shock torque was an independent and isolated singular pulse. The pulse is applied at a timing Tp, i.e., the transitional load fluctuation occurs at the timing Tp. The curve 62 represents the phase difference for the normalized value when the moment of inertia is 1. The curve 63 represents the phase difference when the normalized valued of the moment of inertia is 2. Through the simulation as described above, it is determined that the amount of the phase difference between the teeth of the stepping motor is reduced when the moment of inertia is greater.

A principle of an embodiment of the present invention is described with reference to FIG. 7. At (a) of FIG. 7, a shock applied to the stepping motor is schematically shown. At (b) of FIG. 7, a change of the driving current applied to the motor is shown. Here, the horizontal axes show the same time.

A shock 71 occurs when the recording medium enters a nip, and a shock 72 occurs when the recording medium leaves the nip. A current increase 73 occurs corresponding to the shock 71, and another current increase 74 occurs corresponding to the shock 72.

Figure 7:
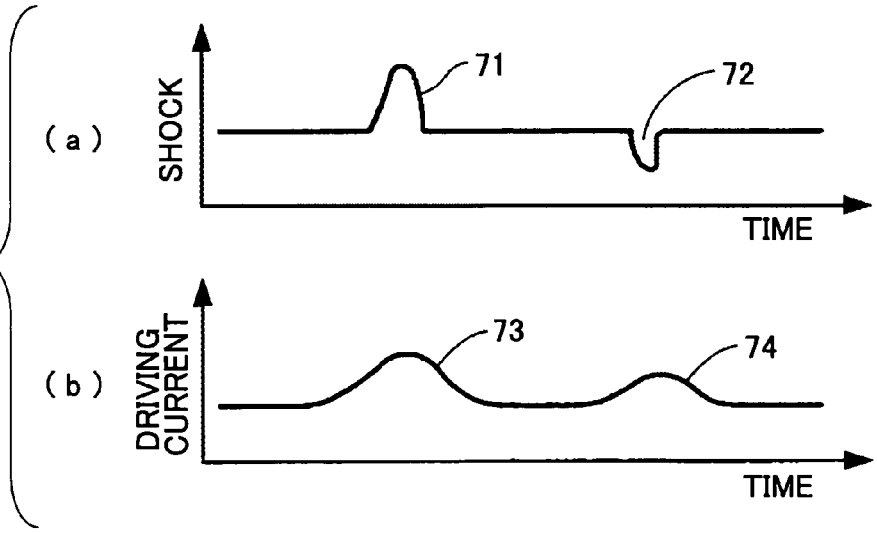
FIG. 7 gives graphs for explaining a basic principle of an embodiment of the present invention.

In FIG. 7, the horizontal axes represent time. At (a), the shocks generated when the recording medium enters and leaves the pressure-contacting nip formed by the driving roller 4 and the countering roller 8 are shown along the vertical axis.

When the recording medium enters the pressure-contacting nip, the shock 71 occurs. Further, when the recording medium leaves the pressure-contacting nip, the shock 72 occurs, which shock 72 is in a reverse polarity to the shock 71. Corresponding to the shocks 71 and 72, an effective driving current (e.g., a sum of currents flowing in the coils of the three phases) provided to the stepping motor is adjusted as shown at (b). The horizontal axis represents the time, and the vertical axis expresses the effective driving current.

In order to reduce an amount of the transitional rotation change of the driving roller due to the shocks 71 and 72, the driving current is temporarily increased as shown by the current increases 73 and 74. Since the torque of the stepping motor is increased by the increased driving current, even if the shocks 71 and 72 occur, associated transitional rotation changes of the driving roller can be reduced. The driving current is adjusted before the shock is generated. When the recording medium enters the pressure-contacting nip, timings of the shocks generated by hitting the imprint belt, the driving roller through the imprint belt, and the countering roller pair vary. Furthermore, timings of hitting the imprint belt, the driving roller through the imprint belt, and the countering roller are different from each other. That is, however the shocks occur with different timings, it is necessary to increase the torque of the stepping motor. Further, if the driving current of the stepping motor is rapidly increased, a transitional rotation fluctuation occurs due to the rapid increase of the current, and a transitional rotation fluctuation occurs with the driving roller, resulting in a transitional conveyance speed change at the imprint belt, which degrades image quality, such as by generating concentration unevenness and color shift. In order to mitigate this degradation, the current should be slowly increased and decreased. That is, the current is gradually increased before the shock occurs, and the current is gradually decreased after the shock has subsided.

Start timing for temporarily increasing the driving current can be defined by a predetermined time lapse from a command for the resist roller to send out the recording medium. However, if this provides a timing that is too late, other information may be used.

The period between the recording medium entering and leaving a nip depends on the length of the recording medium. Although the timing of the recording medium entering can be acquired based on an actuating signal of the resist roller, and the like, as described above, the timing of the recording medium leaving the nip has to take the length of the recording medium into consideration. This can be realized by providing detectors for detecting timings of the tip of the recording medium entering and the end of the recording medium leaving, and by obtaining the difference between the timings. Alternatively, only the timing of the tip of the recording medium entering may be detected; in this case, the length of the recording medium is to be specified by a user when printing, and a table containing a time difference corresponding to the length of the recording medium is referenced. Then, the corresponding time difference is obtained with reference to the table, the driving current is increased at the predetermined start timing for the tip of the recording medium, and after the time difference for the end of the recording medium.

According to the present invention, the transitional load fluctuation is mitigated by one of or both the electric technique of controlling the current provided to the motor as described above, and the mechanical technique using the shock relief mechanism as shown in FIGS. 5A and 5B.

Figure 8:
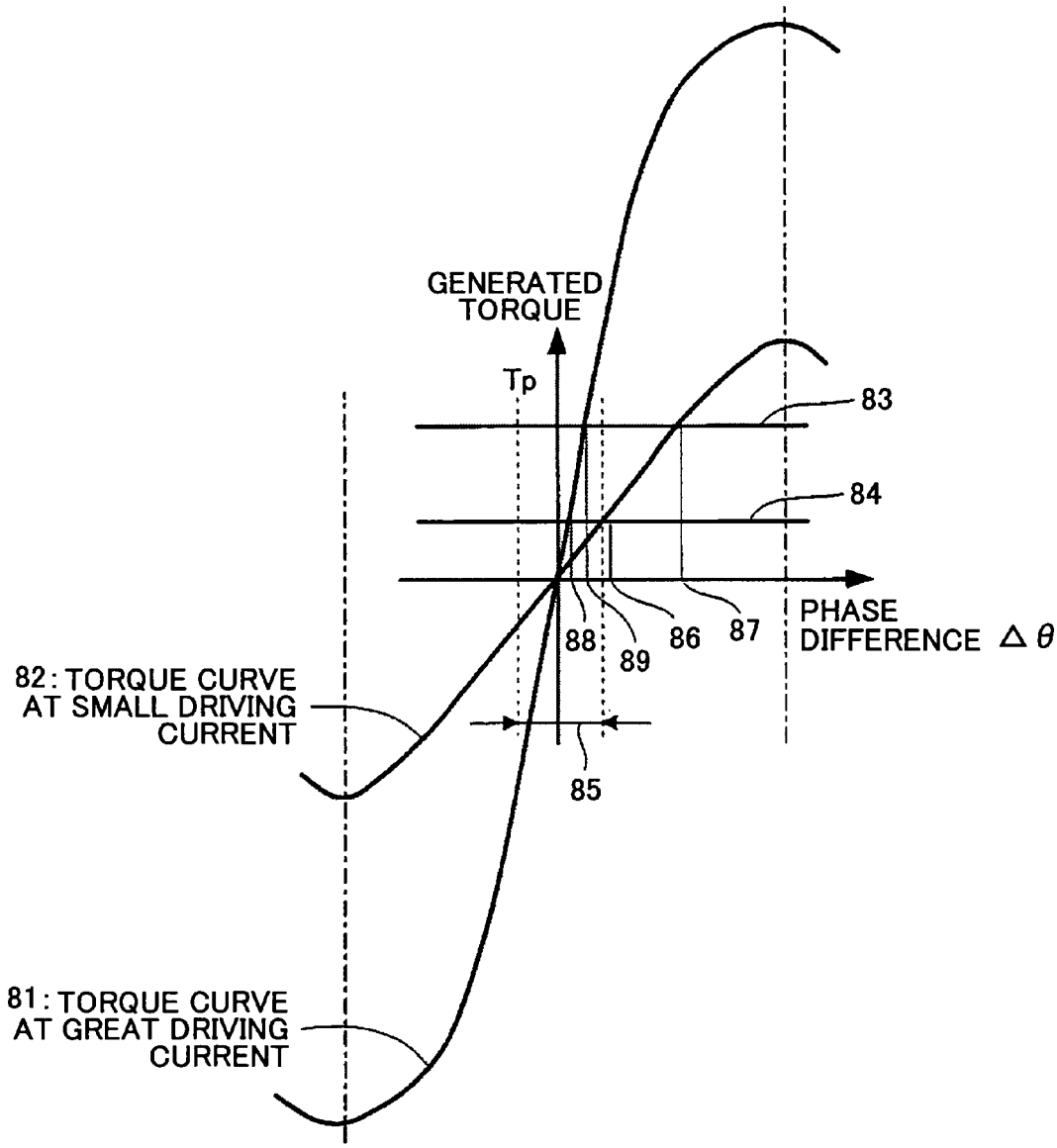
FIG. 8 is a graph showing a torque diagram of the motor.
Figure 9:
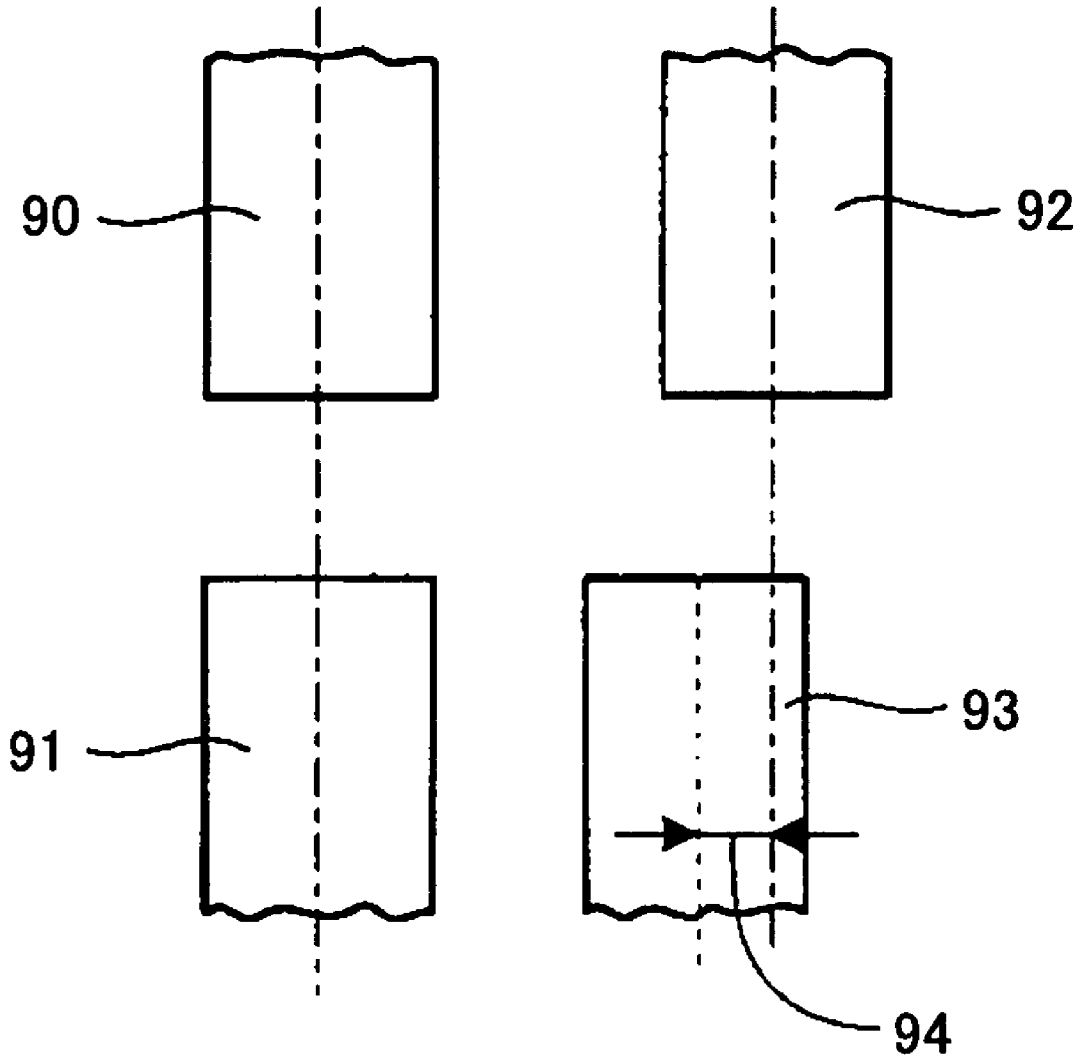
FIG. 9 is a schematic diagram for explaining operations of the motor by relative positions of teeth of a rotor and a stator.

FIG. 8 is a torque diagram of the motor, and FIG. 9 is for describing operations by relational positions of the teeth of the rotor and the stator.

FIG. 8 shows a torque curve 81 corresponding to a greater driving current, a torque curve 82 corresponding to a smaller driving current, a transitional torque load fluctuation 83, and a regular torque load 84. FIG. 8 further gives an allowable image quality threshold 85, a phase difference 86 due to the regular torque load at a regular driving current, a phase difference 87 due to the transitional torque load fluctuation at the regular driving current, a phase difference 88 due to the regular torque load at an increased driving current, and a phase difference 89 due to the transitional torque load fluctuation at the increased driving current.

FIG. 9 shows stator teeth 90 and 92; rotor teeth 91 and 93; and a phase difference 94 between the rotor and the stator.

FIG. 8 and FIG. 9 schematically illustrate relationships between a gap (a phase difference $\Delta\theta$) in the rotation direction of the countering teeth (or the polarity) of the rotor and the stator, a torque Tp generated by the stepping motor, and the driving current I. While the stepping motor carries out microstep driving with a sine-wave current flowing through a coil and is rotating, the stator generates a rotating magnetic field (or virtually a rotating magnetic pole), the strength of which magnetic field varies in the rotation direction corresponding to the sine wave. When there is no load, a peak of the magnetic field strength rotates in sync with the tooth of the rotor. This is where there is no rotation angle difference or no rotational angular velocity difference, and is an ideal situation where no quality-of-image degradation occurs due to concentration unevenness and color shift described above.

In order to facilitate the explanation, FIG. 8 and FIG. 9 illustrate a situation wherein a regular component of the rotation is removed, and only a variable component of the rotation is shown. That is, the tooth 90 of the stator represents a position where the rotating magnetic field is peaked, and the tooth 91 is the countering rotor tooth. In this way, a qualitative discussion about the fluctuation of the rotor due to the transitional load fluctuation of the stepping motor is made equivalent to a discussion about where the stepping motor is stopped and a current is provided only to a coil of one phase of the stator. That is, it is the situation wherein the magnetic poles 90 and 92 of the stator shown in FIG. 9 are excited. With reference to FIG. 8, the horizontal axis represents the phase difference $\Delta\theta$ between the countering teeth (magnetic poles) of the rotor and the stator, and the vertical axis represents the torque Tp generated in the rotation direction. Further, lines that are parallel to the horizontal axis indicated with 83 and 84 are the maximum shock torque 83 and the regular torque load 84, respectively. When the phase difference $\Delta\theta=0$, the torque generated by the stepping motor is zero.

The phase difference $\Delta\theta$ is described with reference to FIG. 9. Each of the teeth 90 and 92 represents one tooth (magnetic pole) of the stator, and each of the teeth 91 and 93 represents one tooth (magnetic pole) of the rotor. If the stepping motor is a PM (permanent magnet) type, a magnetic member counters a magnetic pole of the permanent magnet, where an N pole and an S pole are alternately arranged, and a torque is generated by attractive force and repulsive force by countering with the magnetic member. If the stepping motor is a VR (variable reluctance) type, teeth of the magnetic member counter, and the torque is generated only with attractive force. A hybrid type is a magnetized tooth of the magnetic member and a magnetized tooth of the magnetic member countering, and the magnetic members sandwiching a magnet, wherein the torque is generated by the tooth of the magnetic member and the countering tooth of the magnetic member.

As described above, the torque is generated by the attractive force and the repulsive force between the countering teeth (magnetic poles). Accordingly, when there is no phase difference ($\Delta\theta=0$) as in the case of the teeth 90 and 91 in FIG. 9, no torque is generated in the rotation direction, although the teeth attract each other. In the case of the teeth 92 and 93 in FIG. 9, there is a phase difference 94, and the phase difference 94 generates a torque in the rotation direction according to a magnitude of the phase difference 94.

With reference to FIG. 8, the torque curve 82 shows the torque generated by the stepping motor when a usual driving current is flowing. That is, for the regular torque load 84, the phase difference 86 occurs; and for the maximum shock torque 83, the phase difference 87 occurs. That is, a phase difference as great as the phase difference 87 occurs. On the other hand, the torque curve 81 illustrates the case where a greater driving current is provided for obtaining a greater torque. Here, for the maximum shock torque 83, the phase difference 89 occurs; that is, the magnitude of the phase difference is smaller than for the case of the torque curve 82. That is, if the driving current is increased, the phase difference is reduced. Accordingly, if the allowable displacement angle 85 in terms of a rotation angle of the stepping motor corresponding to an allowable position gap on the recording medium in view of the quality of image is predetermined, a required driving current value can be calculated. Further, a shock on the negative side (not illustrated here) and an associated torque can be considered in the same way as the positive side that is described above. If the driving current is increased, at the regular torque load, there is only a smaller amount of phase difference, i.e., the phase difference 88. However, if the increased driving current is always provided, the motor will generate heat, consuming a greater amount of power. In order to maintain the reliability of the stepping motor, dimensions of the stepping motor are enlarged to cope with the heat.

As shown in FIG. 8, the greater the inclination of the torque curve of the stepping motor is, the smaller the influence of the shock torque becomes. The inclination can be increased not only by increasing the driving current, but also by decreasing the pitch (making finer pitches) of the teeth (magnetic poles) of the stepping motor. If a finer-pitch stepping motor is used, controlling the driving current can be dispensed with. However, a highly precise process and assembly are required, which raises cost of the stepping motor.

Figure 10:
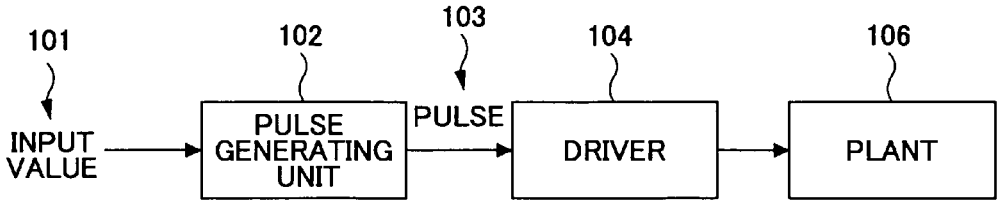
FIG. 10 is a block diagram of a drive control system for controlling a driving current of the motor.

FIG. 10 is a block diagram of a drive control system for increasing the driving current.

The drive control system includes a pulse generating unit 102 for generating a pulse 103, a driver 104, and a plant 106. An input value 101 is provided to the pulse generating unit 102.

The drive control system is for increasing the driving current provided to a configuration such as shown in FIGS. 5A and 5B, the driving current being increased as shown at (b) of FIG. 7 corresponding to the transitional load fluctuations as shown at (a) of FIG. 7. The input value 101 that is provided to the pulse generating unit 102 represents a target rotation angle or a target rotational speed of the driving roller. Then, the pulse generating unit 102 outputs a pulse that determines the driving speed of the stepping motor. The pulse 103 is provided to the driver 104. Then, the driver 104 provides the driving current to the coil of the stepping motor so that the stepping motor may rotate in sync with the pulse 103. In the case of a three phase stepping motor, the driving current is provided to coils that are connected in Y or in delta. Two or more lines connected to the coils are connected to the plant 106. The plant 106 includes the stepping motor, an imprint belt, and rotating objects such as a driving roller, and a follower roller.

With the configuration as described above, a driving voltage or a driving current provided to each coil is gradually increased, then decreased after a peak value according to the timing of the transitional load fluctuation. In this way, when a shock is generated by the recording medium entering and departing from the nip formed by the driving roller 4 and the countering roller 8 of FIG. 1, the driving current to the stepping motor can be adjusted as shown at (b) of FIG. 7. The stepping motor contained in the plant 106 is driven by the driving voltage or driving current provided to each phase from the driver 104.

Figure 11:
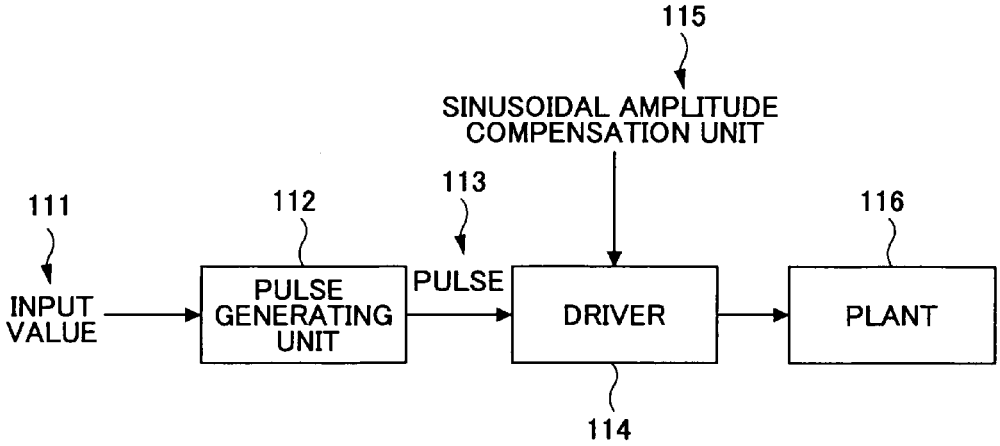
FIG. 11 is a block diagram of the drive control system when driving with a sine wave current.

FIG. 11 is a block diagram of a drive control system in the case of the motor driver using a driving current in the shape of a sine wave.

The drive control system includes a sinusoidal amplitude compensation unit 115.

An input value 111 representing the target rotation angle or the target rotational speed of the driving roller is provided to a pulse generating unit 112. The pulse generating unit 112 generates a pulse 113 based on the input value 111. The pulse 113 is provided to a driver 114.

The driver 114 is for providing a current to a motor coil, and includes two or more lines connected to the plant 116. The driver 114 selectively provides a current to the coils so that the stepping motor may rotate in sync with the pulse 113. In the case of the three-phase stepping motor, for example, the coils are connected in Y or delta. When driving the three phase stepping motor, the driver 114 generates three continuous sine waves that are phase-shifted by 120 degrees to each other in sync with the pulse 113, and currents with values in the shape of a sine wave flow through the coils. This corresponds to excitation of the coils of the phases at (c) of FIG. 4, except that the sine wave is used instead of the rectangular wave. Further, according to the timing of the transitional load fluctuation, the sinusoidal amplitude compensation unit 115 increases and decreases (after a peak value) the amplitude of the sine waves provided to the driver 114. In this way, the shock generated by the recording medium entering and departing from the nip formed by the driving roller 4 and the countering roller 8 of FIG. 1 is reduced. That is, as shown at (b) of FIG. 7, all the driving currents provided to the stepping motor can be adjusted.

As a method of sine-wave current driving, a micro-step driving method is known. Therein, the current of each phase of a step angle at the time of a usual full step drive is increased and decreased in steps such that attracting force of the rotor between phases is gradually changed. According to the micro-step drive, by increasing the number of steps, the current can be increased/decreased to be close to a smooth sine wave.

Figure 12:
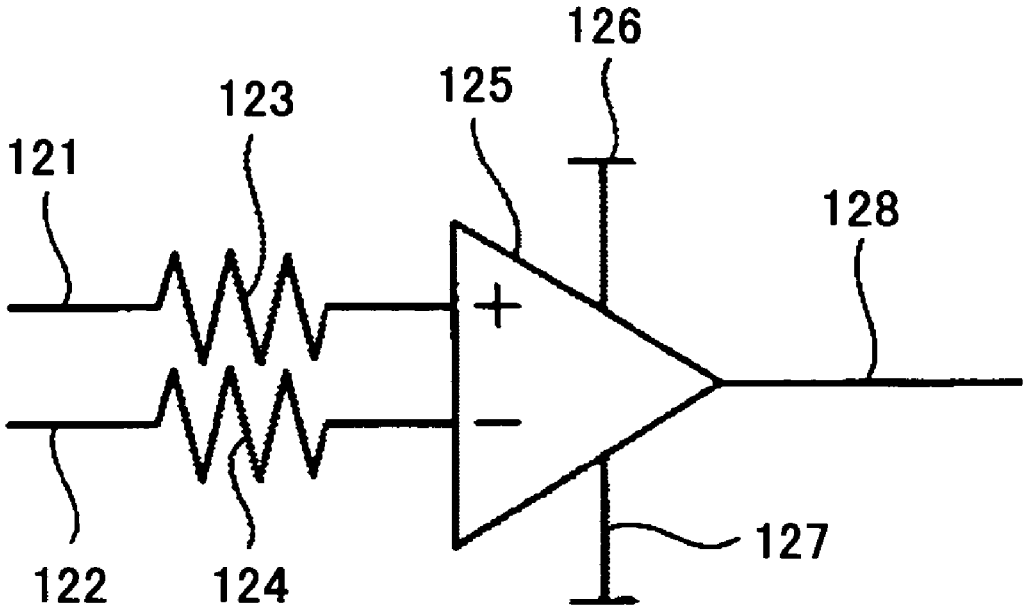
FIG. 12 is a circuit diagram of a PWM signal generating circuit.

FIG. 12 is a circuit diagram of a PWM signal generating unit that includes input terminals 121 and 122; resistors 123 and 124; a comparator 125; power supply terminals 126 and 127; and an output terminal 128.

A driving current of the motor is often controlled by PWM. A positive side of the power supply is connected to the terminal 126 of the comparator 125, and a negative side is connected to the terminal 127.

The sine wave to be compared with is provided to an absolute value circuit (not illustrated) for converting a negative signal into a positive signal. The sine wave output by the absolute value circuit is provided to the comparator through the input terminal 121 and the resistor 123. Further, a triangular wave of a predetermined frequency (generally about 20 kHz) is provided to the comparator through the input terminal 122 and the resistor 124. The comparator 125 compares the signal provided to the input terminal 121 and the signal provided to the input terminal 122. Then, if a voltage of the input terminal 121 is higher than a voltage of the input terminal 122, for example, an H signal is output; otherwise, an L signal is output. In this way, a pulse train 128 is obtained, wherein a pulse duty of the pulse train changes at the predetermined frequency according to the amplitude of the sinusoidal input. That is, if the amplitude of the sine wave is great, the pulse duty is great. The pulse train 128 obtained from the comparator 125 is output for driving the stepping motor. With reference to the Y connection shown by FIG. 4B, in the case of driving, for example, the coil CU with the sinusoidal PWM drive, the switching transistor 32 is driven while the sinusoidal input signal is positive, and the switching transistor 33 is driven while the sinusoidal input signal is negative.

FIGS. 13A, 13B, 13C, 13D, and 13E show countering states of magnetic poles (teeth) in the micro-step drive.

In the drawings, teeth 131 and d132 are adjacent to each other, the teeth 131 and 132 counter tooth 133, and $\theta_0$ represents a phase difference.

Where the micro-step drive is carried out by providing a sine-wave current to a coil, a three phase stepping motor is advantageous in view of lower vibration as compared with a two phase stepping motor. Therefore, the three phase stepping motor is suitable for realizing a high quality image formation apparatus.

However, in order to simplify explanation here, the principle of the micro-step drive in the case of the two-phase stepping motor is described.

Figure 13A:
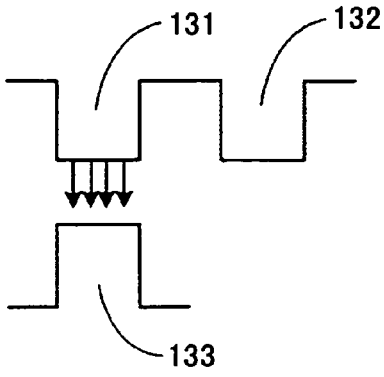
FIGS. 13A, 13B, 13C, 13D, and 13E are schematic diagrams showing countering states of magnetic poles (teeth) of a micro-step drive.
Figure 13B:
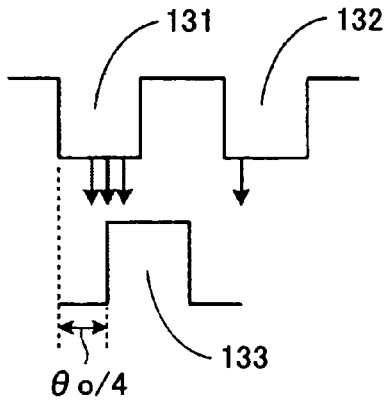
Figure 13C:
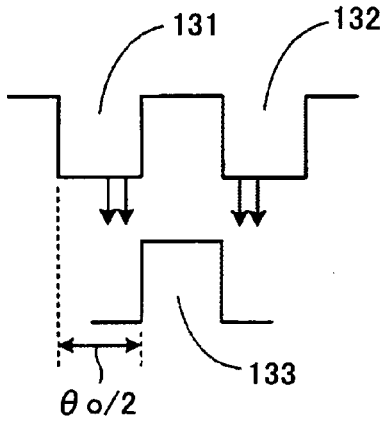
Figure 13D:
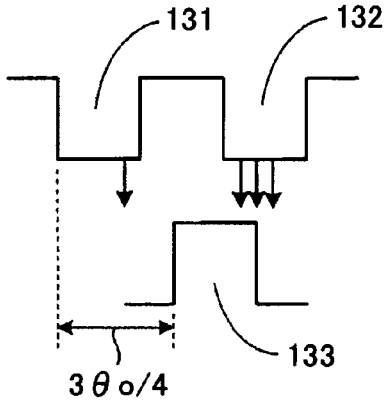
Figure 13E:
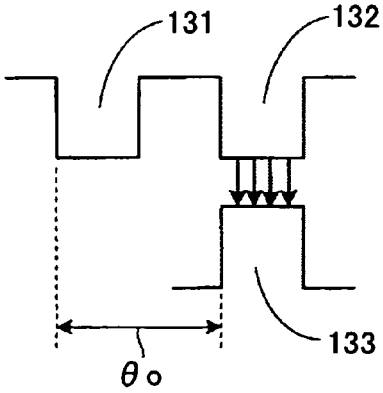

An example of motion of a tooth is described with reference to FIGS. 13A, 13B, 13C, 13D, and 13E, wherein the micro-step drive is carried out in four steps. Current in four steps of amplitude is provided to the coil of each phase, where the amplitudes of the steps are called one step, two steps, three steps, and four steps. Each of FIGS. 13A, 13B, 13C, 13D, and 13E shows the tooth 131 of the stator on the upper left-hand side, the tooth 132 of the stator on the upper right-hand side, and the tooth 133 of the rotor under the teeth 131 and 132. In FIG. 13A, the tooth 131 and the tooth 133 face each other with no phase difference and four steps of current are flowing, i.e., magnetic attraction corresponding to the four steps is applied. Here, a phase difference equivalent to a difference by one tooth is represented by $\theta_0$ as shown in FIG. 13E. At the next step shown in FIG. 13B a three-step current flows through the tooth 131 and a one-step current flows through the tooth 132. Since the magnitude of attraction is proportional to the magnitude of the current, the tooth 133 is shifted by $\theta_0/4$. Then, at the next step shown in FIG. 13C, a two-step current flows through the tooth 131 and a two-step current flows through the tooth 312; accordingly, the tooth 133 is shifted to $\theta_0/2$. Then, at the next step shown in FIG. 13D, a one-step current flows through the tooth 311 and a three-step current flows through the tooth 132 so that the tooth 133 is shifted to $3\theta_0/4$. Finally, at the next step shown in FIG. 13E, zero current flows through the tooth 131 and a four-step current flows through the tooth 132 so that the phase returns to the first state. This is the micro-step drive in 4 steps.

That is, since the phase difference $\theta_0$ is made into steps, the rotor shifts by $\theta_0/4$ as the magnitudes of the current changes every step. By increasing the number of the steps, the current waveform can be brought close to a sine wave, which is called a pseudo sine wave.

Figure 14:
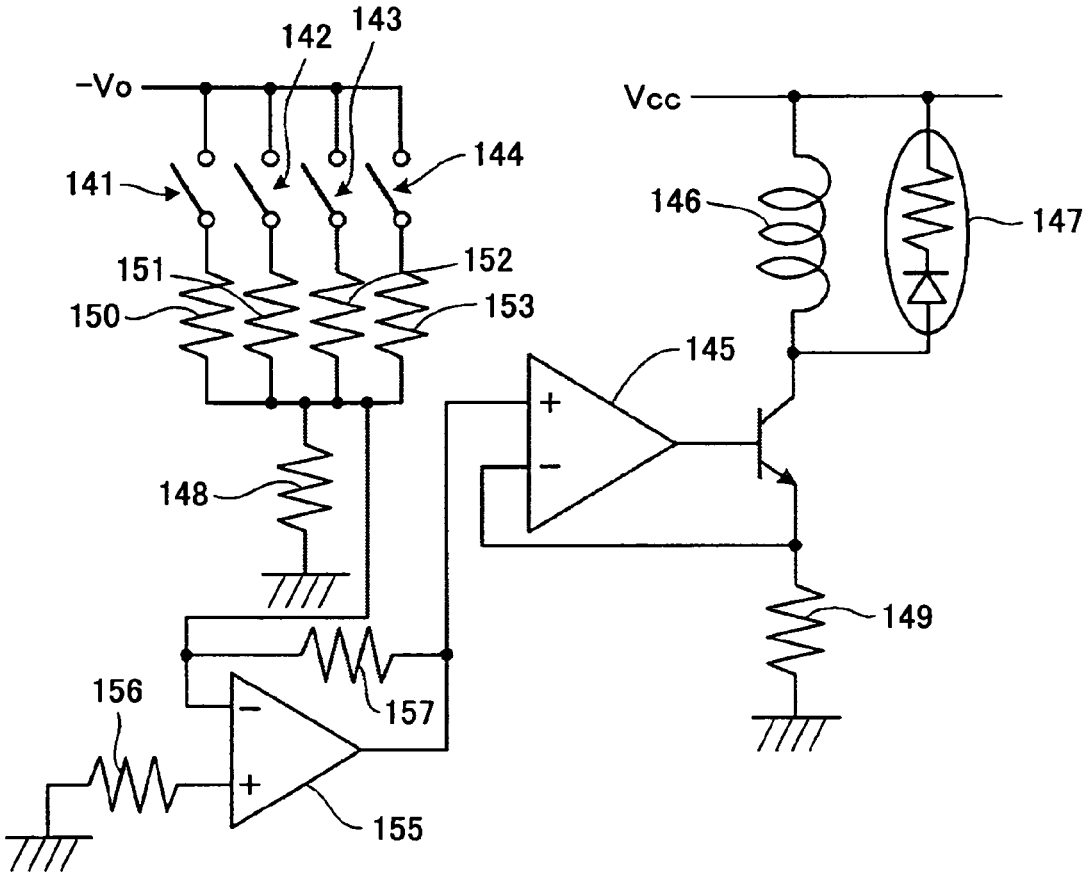
FIG. 14 is a circuit diagram of a drive circuit of the micro step.

FIG. 14 is a circuit diagram of a drive circuit of the micro step, the drive circuit including:

switches 141 through 144;

an operational amplifier 145;
a motor coil 146;
a back EMF protection circuit 147;
resistors 148 and 149;
resistors 150 through 153;
an operational amplifier 155; and
resistors 156 and 157.

In the following, an example of a step waveform generating circuit for one phase of a stepping motor of a 2-phase VR type, a PM type, or a hybrid type is described, wherein a stator magnetic pole is excited by two coils that are wound in bifilar (two wires are wound together). There, when a current flows through one of the coils, a first polarity is obtained; and when a current flows through the other coil, a second polarity, which is the reverse of the first polarity, is obtained; this is called a unipolar method. Further, in order to facilitate the description, the example employs 4-step driving.

A voltage −V0 is provided to an end of each of the switches 141 through 144. The other end of each of the switches 141 through 144 is connected to an end of the resistors 150 through 153, respectively. The other ends of the resistors 150 through 153 are united (connected to each other) at a uniting point. The uniting point is grounded through the resistor 148, and is also connected to a negative (−) terminal of the operational amplifier 155 that serves as an adder circuit. Further, a positive (+) terminal of the operational amplifier 155 is connected to ground through the resistor 156. Here, all the resistors 150 through 153 have the same resistance value. An output terminal of the operational amplifier 155 is connected to a positive (+) terminal of the operational amplifier 145, and is connected to the negative (−) terminal of the operational amplifier 155 through the resistor 157. An output terminal of the operational amplifier 145 is connected to a base of a transistor, and the transistor's emitter is connected to a negative (−) terminal of the operational amplifier 145, and to ground through the resistor 149. A collector of the transistor is connected to an input voltage Vcc through the motor coil 146, and the back EMF protection circuit 147. This forms a well-known current source type amplifier that provides a current I to the motor coil 146. Here, I=Vref/Ro, where Vref is an input voltage to the positive terminal of the operational amplifier 145, and Ro is a resistance value of the resistor 149.

When all the switches 141 through 144 are turned off, since the input to the negative terminal of the operational amplifier 155 is ground level through the resistor 148, and the positive terminal of the operational amplifier 145 is ground level, no current flows through the motor coil.

When only the switch 141 is turned on, the voltage −V0 is applied to the resistor 150. A voltage V corresponding to the voltage −V0 is provided to the positive terminal of the operational amplifier 145 and a corresponding current flows through the motor coil 146. Next, when the switches 141 and 142 are turned on, the voltage −V0 is applied to the resistors 150 and 151. That is, twice the voltage, i.e., 2 V is output by the operational amplifier 155. Thereby, twice the current flows through the motor coil 146. Similarly, when the switches 141 through 143 are turned on, 3 V is output and 3 times the current flows through the motor coil 146; and when all the switches are turned on, 4 times the current flows through the motor coil 146. Afterward, by turning of the switches one by one, the current that flows through the motor coil 146 is decreased in the four steps.

Although the number of steps is 4 in this description, the number can be increased so that the current that flows through the motor coil 146 may approximate a sine wave.

By providing a current of the pseudo sine wave amplitude to each phase of the coil of the stepping motor as described above, torque that is almost constant can be generated.

Figure 15:
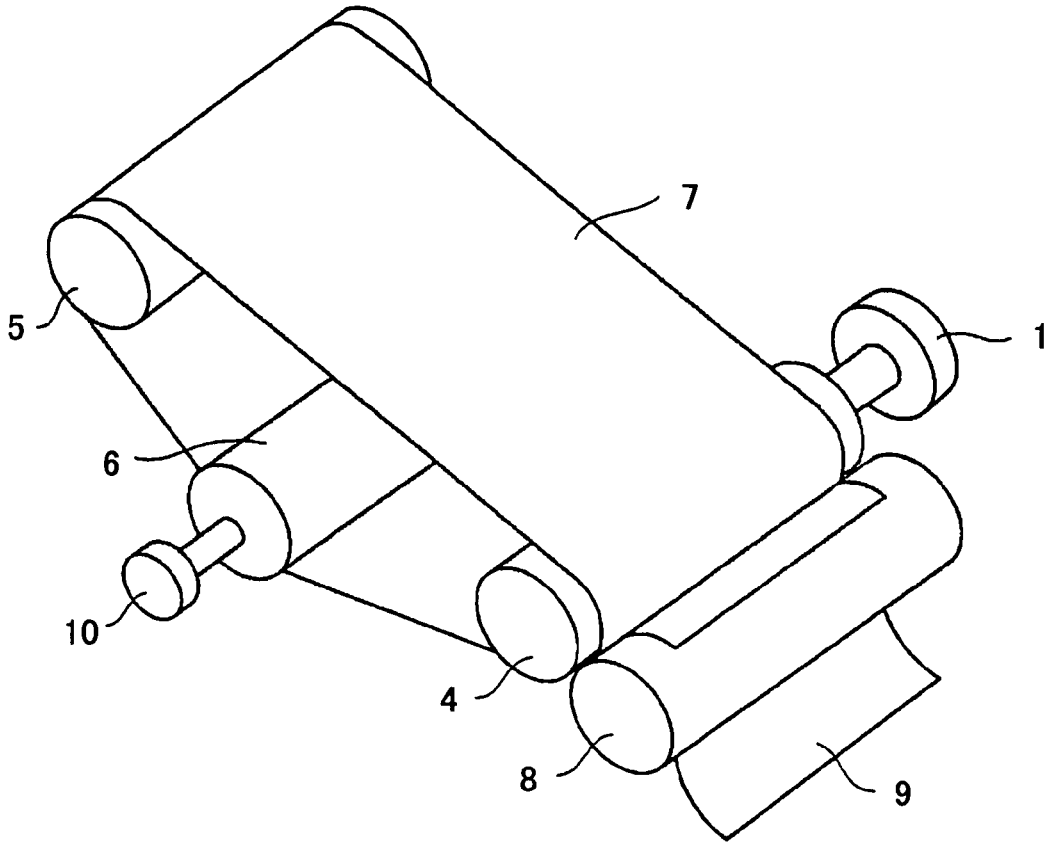
FIG. 15 is a perspective diagram showing a rotational encoder that is attached to a follower roller of the belt type imprinting apparatus.

FIG. 15 is a schematic diagram of another belt type imprinting apparatus according to the present invention, wherein a rotational encoder 10 is arranged to the follower roller 6.

The belt type imprinting apparatus shown by FIG. 15 is fundamentally the same as shown in FIG. 1; the difference is that the rotational encoder 10 is added.

The driving roller 4 is concentrically arranged with the axle of the stepping motor 1 such that the stepping motor 1 directly drives the driving roller 4. The imprint belt 7 is wound around the driving roller 4 and the follower rollers 5 and 6. The rotational encoder 10 for measuring a moving speed of the imprint belt is arranged concentric with the follower roller 6. Here, although the rotational encoder 10 is arranged on the follower roller 6 in this example, the rotational encoder 10 may be attached to the follower roller 5.

Figure 16:
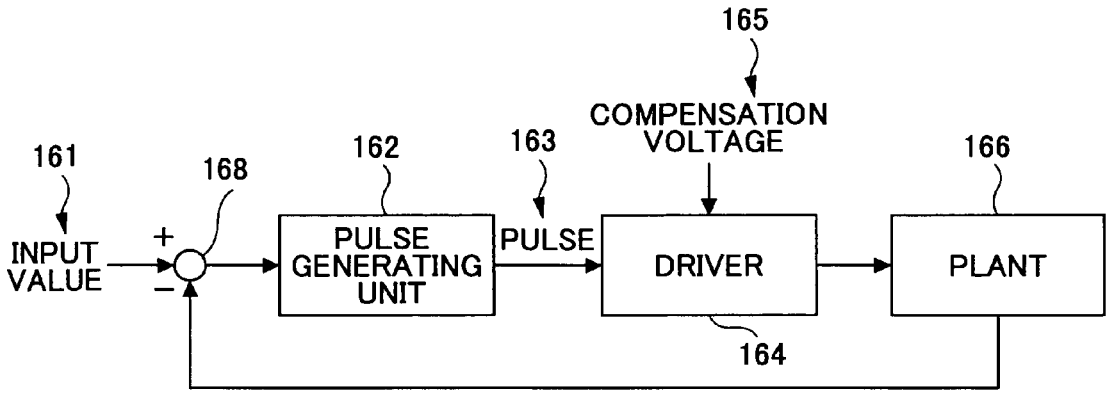
FIG. 16 is a block diagram of the drive control system wherein feedback control by the rotational encoder is performed.

FIG. 16 is a block diagram of the drive control system, wherein feedback control using the rotational encoder 10 is performed.

FIG. 16 shows the case wherein the driving current for the configurations of FIGS. 5A and 5B is increased according to the transitional load fluctuation as shown in FIG. 7, a rotation angle (or rotation angular velocity) is measured by the rotational encoder attached to the follower roller, and the feedback control is carried out. The input value 161 representing the target rotation angle (or target rotation angular velocity) of the follower roller to which the rotational encoder is arranged is compared with a value of the fed-back rotation angle (or rotation angular velocity) by the subtractor 168. In this way, a difference between the present rotation angle (or rotation angular velocity) and the target rotation angle (or target rotation angular velocity) is obtained. The pulse 163 that determines the driving speed of the stepping motor is generated and output from the pulse generating unit 162 based on the difference. The pulse 163 is provided to the driver 164. The driver 164 provides currents in sync with the pulse 163 to, e.g., the Y-connected or delta-connected coils of the three-phase stepping motor.

At this time, the voltages to the coils are gradually raised according to the timing of the transitional load fluctuation, and are gradually decreased after a peak value. In this way, according to the shock generated by the recording medium entering and departing from the pressure-contacting nip of the driving roller 4 and the countering roller 8 (FIG. 15), the driving currents of the stepping motor can be adjusted as shown at (b) of FIG. 7.

Lead wires of the coils are led into the plant 166. The plant 166 includes the stepping motor, the imprint belt that is the target to drive, the rotating objects (such as the driving roller and the follower roller), and the rotational encoder. In the plant 166, the rotation angle (or rotation angular velocity) is measured by the rotational encoder attached to the follower roller, and feed back is carried out based on the measured value.

As described above, the belt driving system is realized, wherein the influence of a slide occurring between the belt and the driving roller is reduced, unless there is a slide between the belt and the follower roller (to which the rotational encoder is arranged). Further, according to the belt driving system, the transitional load fluctuation due to the recording medium entering and departing from the nip is reduced, and vibration at a high frequency region during uniform driving is reduced by providing the stepping motor that is capable of adjusting the driving current according to the transitional load fluctuation, the flywheel that gives the moment-of-inertia effect, and the feedback control based on measurements of the rotation angle (or rotation angular velocity) of the follower roller by the rotational encoder. Here, the follower roller that does not cause sliding with the belt can be realized by, e.g., decreasing the moment of inertia of the follower roller.

Alternatively, the drive control system for the configuration shown in FIGS. 5A and 5B can be configured with PWM driving carried out according to the transitional load fluctuation as shown at (a) of FIG. 7. There, the feedback control may be carried out using the rotation angle (or rotation angular velocity) measured by the rotational encoder attached to the follower roller. Since a block diagram for this drive control system is the same as FIG. 16 in appearance, descriptions about this drive control system use FIG. 16.

The input value 161 representing the target value of the rotation angle (or rotation angular velocity) of the follower roller, to which the rotational encoder is arranged, is compared with the fed-back rotation angle (or rotation angular velocity) by the subtractor 168, and a difference between the present rotation angle (or rotation angular velocity) and the target rotation angle (or target rotation angular velocity) is obtained. The pulse 163 that determines the driving speed of the stepping motor is generated and output by the pulse generating unit 162 based on the difference. The pulse 163 is provided to the driver 164. The driver 164 provides currents to the motor coils, lead wires of which motor coils are led into the plant 166. The driver 164 provides the currents to the motor coils, which coils are Y-connected or delta-connected, in the case of the three phase stepping motor, such that the stepping motor may rotate in sync with the pulse 163.

The driver 164 generates a pulse whose duty rate is changed based on comparison between a sine wave and a triangular wave for carrying out PWM, and provides currents to the phases of the motor.

Here, the amplitude of the sine wave is increased according to the timing of the transitional load fluctuation, and is decreased after a peak value. In this way, the pulse duty ratio of PWM is increased according to the shock generated by the recording medium entering and departing from the pressure-contacting nip formed by the driving roller 4 and the countering roller 8 shown in FIG. 1 such that all the driving currents of the stepping motor can be changed as shown at (b) of FIG. 7.

In this way, the driving roller, the imprint belt, and the follower roller contained in the plant 166 are driven, and feed back control is carried out by the rotational encoder attached to the follower roller measuring the rotation angle (or rotation angular velocity), and feeding back a measured value.

According to the conventional technology, a change in the rotation angle (or rotation angular velocity) generated by the transitional load fluctuation due to the shock is detected through feed back; accordingly, there is a time delay, and influence by the shock cannot be reduced; and as a result, quality-of-image is degraded. In contrast, according to the present invention, the torque of the stepping motor is increased before a shock occurs, the increased torque being capable of countering the shock. Therefore, there is no problem of the time delay. Since the stepping motor is used, the rotation angular velocity can be controlled according to the frequency of an input pulse. In general, the rotation angle (or rotation angular velocity) is subject to change by a normal load fluctuation, a transitional load fluctuation, and driving current fluctuation. However, by providing and controlling the driving current of the stepping motor according to the present invention as described above, the change does not cause degradation of quality of image. Furthermore, if the outer rotor type stepping motor is used, great torque can be generated, vibration in a high frequency region can be reduced by the flywheel effect of the rotor, and the peak of the rotation change by the shock is reduced.

Furthermore, by providing the apparatus that gives the viscosity effect and the flywheel effect, the vibration of the stepping motor is reduced, and the peak of the rotation change to the shock and vibration can be promptly decreased.

Figure 35:
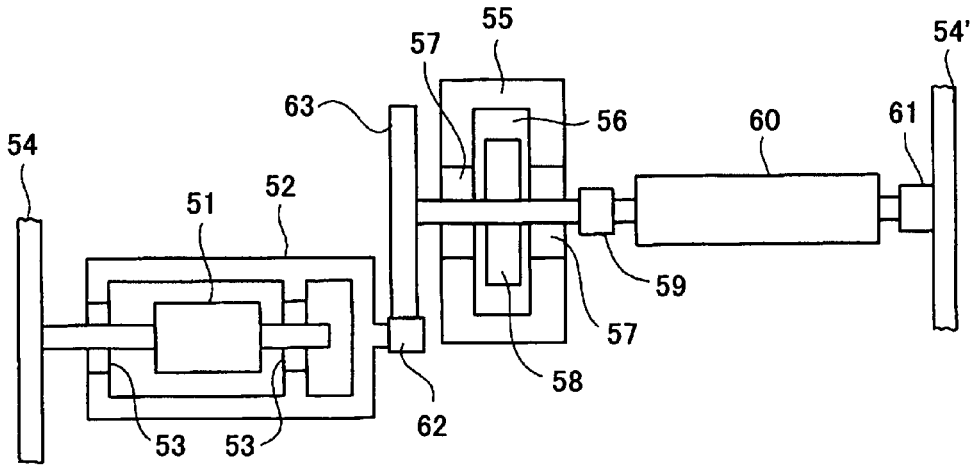
FIG. 35 is a schematic diagram of a modification of Embodiment 1.
Figure 36:
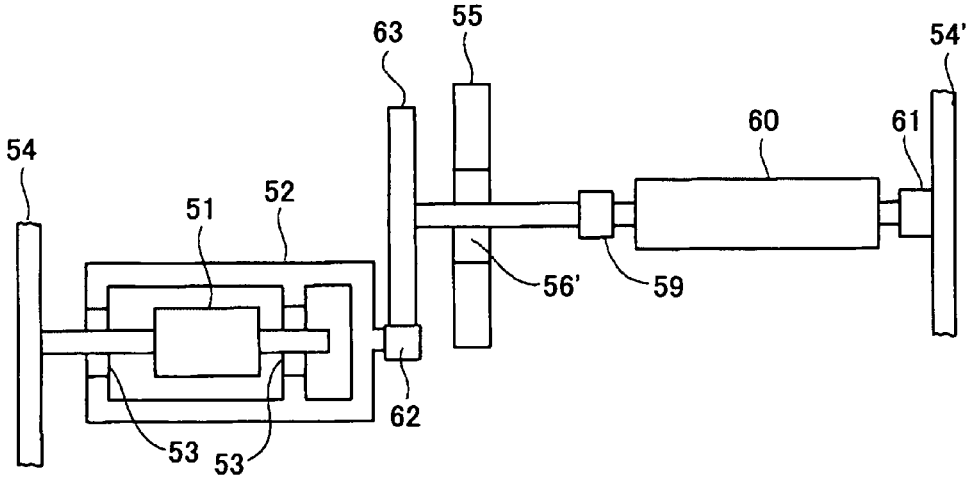
FIG. 36 is a schematic diagram of a modification of Embodiment 1.

FIGS. 35 and 36 are schematic diagrams of modifications of Embodiment 1. FIG. 35 shows the modification to the structure shown in FIG. 5A, and FIG. 36 shows the modification to the structure shown in FIG. 5B.

Each of the modifications includes a driving gear 62, and a follower gear 63.

Although the modifications are fundamentally the same as Embodiment 1, a motor output axle and a driving roller axle are not concentric according to the modifications.

Descriptions of the modifications may contain what have been presented with reference to FIG. 5. The modification shown by FIG. 35 is described.

The stator 51 is formed and fixed on the axle that is fixed to the side plate 54 that is fixed to the image formation apparatus. The outer rotor 52 is supported by the outer roller bearing 53 placed on the axle that is fixed to the side plate 54, and is rotated by the rotating magnetic field generated by the stator 51. The outer rotor 52 drives the driving gear 62 that rotates with the outer rotor 52. The driving gear 62 is in meshing engagement with the follower gear 63, which follower gear 63 is concentrically fixed to one end of the driving roller 60 through the universal joint 59. The other end of the driving roller 60 is supported by the bearing 61 that is fixed to the side plate 54' that counters the side plate 54. Further, the rotor 58 and the flywheel 55 are arranged on the roller rotation axle, rotating in one body with the driving roller 60. The rotator 58 rotates with the roller rotation axle, and the flywheel 55 supported by the bearing 57 can freely rotate. The space between the flywheel 55 and the rotor 58 is filled with the viscous material 56, such as silicon. While the driving roller 60 is rotating at a constant angular velocity, the rotor 58 also rotates at the constant angular velocity. Further, the flywheel 55 also rotates at the constant angular velocity through the viscous material 56. When there occurs a shock (transitional load fluctuation) generated by the recording medium entering the nip formed by the driving roller 4 and the countering roller 8 (FIG. 1), the angular velocity of the rotor 58 is changed due to the shock, but the flywheel 55 tends to maintain the rotation at the constant speed due to its great moment of inertia. Accordingly, a relative velocity (a difference in velocities) occurs between the flywheel 55 and the rotor 58. The relative velocity is reduced by the damping effect of the viscous material 56. As a result, the peak value of the transitional rotation velocity change is reduced. Furthermore, the flywheel 55, the rotor 58, the viscous material 56, and the bearing 57 function to stabilize vibration of the stepping motor.

Next, a configuration shown by FIG. 36 is briefly described.

The stator 51 is formed and fixed to the axle that is fixed to the side plate 54 that is fixed to the image formation apparatus. The outer rotor 52 is supported by the outer roller bearings 53 placed on the axle fixed to the side plate 54, and can be rotated by the rotating magnetic field generated by the stator 51. Further, the driving gear 62 that rotates in one body with the outer rotor 52 is arranged, and driving force is transmitted to the follower gear 63 that is in meshing engagement with the driving gear 62. The follower gear 63 is jointed to one end of the driving roller 60 through the universal joint 59 on the rotation axle of the roller. The other end of the driving roller 60 is supported by the bearing 61 that is fixed to the side plate 54' that counters the side plate 54. Further, the flywheel 55 is supported by an elastic body 56', such as rubber, on the rotation axle of the roller that rotates in one body with the driving roller 60.

In this way, when there is a shock (transitional load fluctuation) generated by the recording medium entering the nip formed by the driving roller 4 and the countering roller 8 (FIG. 1), the flywheel 55 tends to maintain the angular velocity due to the moment of inertia and free rotation, and a response to the shock of the flywheel 55 is delayed due to the elastic body 56'. The rotation axle of the motor is controlled by the flywheel 55 that is delayed, and as a result, the peak value of the transitional rotation change is reduced. Furthermore, the flywheel 55, and the elastic body 56' function to stabilize vibration of the stepping motor.

Figure 17A:
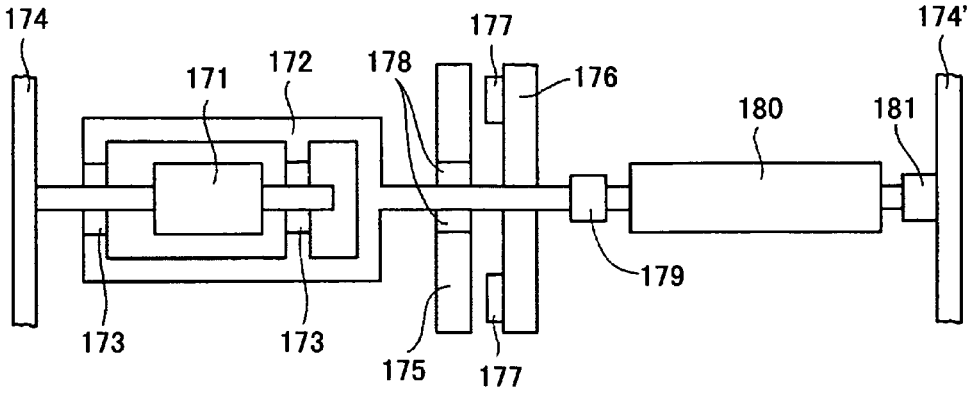
FIG. 17A and FIG. 17B are schematic diagrams for explaining Embodiment 2 of the present invention.

Embodiment 2 of the present invention is described with reference to FIG. 17A and FIG. 17B. FIG. 17A shows the configuration of a stepping motor according to Embodiment 2.

The configuration includes a stator 171, an outer rotor 172, an outer roller bearing 173, a side plate 174, a side plate 174', a magnetic flywheel 175, a magnetic rotating member 176, permanent magnets 177, a driving roller 180, and bearings 178, 179, and 181. FIG. 17B is a front view of the magnetic rotating member 176, to which magnetic rotating member 176 the permanent magnets 177 are attached.

According to Embodiment 2, the transitional rotation change of the driving roller 180 due to the transitional load fluctuation generated by the recording medium passing the nip (such as formed by the driving roller 4 and the countering roller 8 (FIG. 1)) is reduced by increasing the torque of the stepping motor according to the transitional load fluctuation, while the driving roller is rotating at a constant rotation angular velocity by the stepping motor. Further, the magnetic flywheel 175 is an auxiliary mechanism (a shock relief mechanism) for damping the shock and vibration due to the transitional load fluctuation.

According to Embodiment 2, the stepping motor, which serves as a driving source, is of an outer rotor type. The stator 171 is fixed to the axle that is fixed to the side plate 174 that is fixed to the image formation apparatus. The outer rotor 172 is supported by the outer roller bearing 173 placed on the axle that is fixed to the side plate 174, and can be rotated by the rotating magnetic field generated by the stator 171. The outer rotor 172 is joined to one end of the driving roller 180 through the universal joint 179 on the rotation axle of the stepping motor that rotates in one body with the outer rotor 172. The other end of the driving roller 180 is supported by the bearing 181 that is fixed to the side plate 174', the side plate 174' countering the side plate 174. The magnetic rotating member 176 and the magnetic flywheel 175 are arranged on the rotation axle of the stepping motor that rotates in one body with the outer rotor 172. Here, the magnetic flywheel 175 is supported by the bearing 178. The permanent magnets 177 are attached to the magnetic rotating member 176, facing the magnetic flywheel 175. The magnetic rotating member 176 with the permanent magnets 177 constitutes the auxiliary mechanism for mitigating a speed difference between the magnetic flywheel and the rotating body where a transitional torque fluctuation occurs.

Figure 17B:
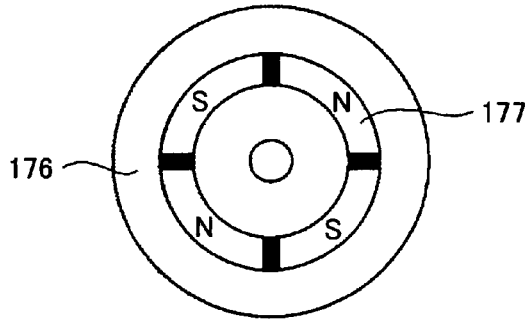

FIG. 17B shows an example of the configuration of the magnetic rotating member 176 containing the permanent magnets 177. Here, four permanent magnets 177 are arranged in the shape of a cylinder in the magnetic rotating member 176. Two permanent magnets 177 are N poles and the other two are S poles. The permanent magnets 177 are arranged such that N poles and S poles are alternately located. The arrangement of the permanent magnets 177 is not limited to this, but other configuration may be used as long as the permanent magnets 177 can magnetically attract the magnetic flywheel 175.

While the driving roller 180 is rotating at a constant angular velocity, the magnetic rotating member 176 also rotates at the constant angular velocity. Since the permanent magnets 177 also rotate in one body with the magnetic rotating member 176, the magnetic flywheel 175 also rotates at the constant angular velocity due to the magnetic attraction of the permanent magnets 177. When there is a shock (transitional load fluctuation) generated by the recording medium entering the nip (such as formed by the driving roller 4 and the countering roller 8 (FIG. 1)), a transitional rotation change occurs at the magnetic rotating member 176, and a relative velocity occurs between the magnetic rotating member 176 and the magnetic flywheel 175; however, since the magnetic flywheel 175 tends to maintain the angular velocity with its great moment of inertia and free rotation, and since the relative speed is reduced by the dumping effect of the magnetism of the permanent magnets 177, the peak value of the transitional rotation change is reduced. Furthermore, the magnetic flywheel 175, the magnetic rotating member 176, and the permanent magnets 177 function to stabilize the vibration of the stepping motor.

Although according to Embodiment 2, the permanent magnets 177 are attached to the magnetic rotating member 176, the permanent magnets 177 can be attached to the magnetic flywheel 175 to obtain the same effect.

Figure 37:
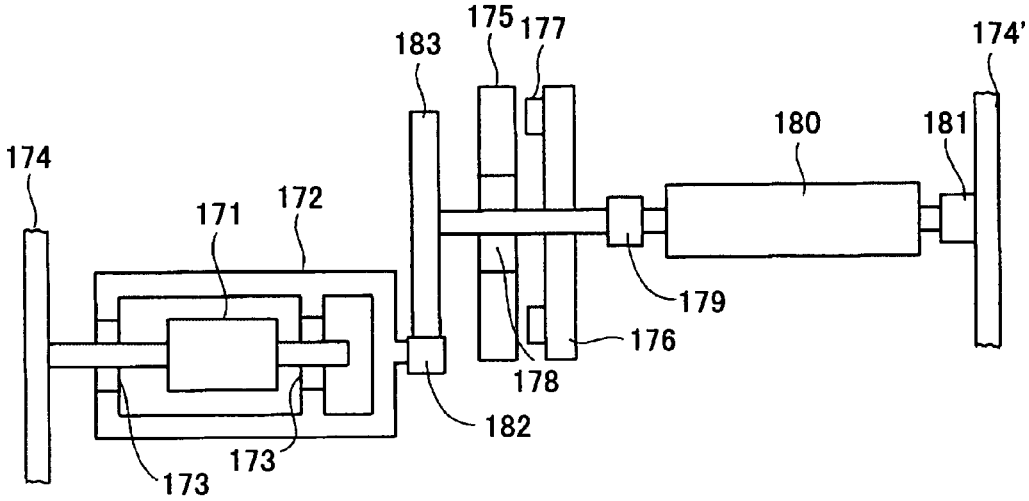
FIG. 37 is a schematic diagram of a modification of Embodiment 2.

A modification to Embodiment 2 is briefly described with reference to FIG. 37.

The modification includes a driving gear 182, and a follower gear 183.

The outer rotor 172 is supported by the outer roller bearing 173 placed on the axle that is fixed to the side plate 174, and can be rotated by the rotating magnetic field generated by the stator 171. The outer rotor 172 drives the driving gear 182 that rotates in one body with the outer rotor 172, and the driving gear 182 is joined to one end of the driving roller 180 through the universal joint 179 on the rotation axle of the roller by gearing with the follower gear 183. The other end of the driving roller 180 is supported by the bearing 181 that is fixed to the side plate 174' that counters the side plate 174. Further, the magnetic flywheel 175 freely rotates in one body with the magnetic rotating member 176 being supported by the bearing 178 on the rotation axle of the stepping motor that rotates in one body with the outer rotor 72. The permanent magnets 177 are attached to the magnetic rotating member 176. According to this modification, four permanent magnets 177, two N poles and two S poles, are alternately arranged in the shape of a cylinder centered on the rotation axle of the magnetic rotating member 176. Nevertheless, other configurations may be used as long as the permanent magnets 177 can magnetically attract the magnetic flywheel 175.

While the driving roller 180 is rotated at a constant angular velocity, the magnetic rotating member 176 and the permanent magnets 177 are also rotated at the constant angular velocity, sharing the same center of rotation as the magnetic rotating member 176. Accordingly, the magnetic flywheel 175 is also rotated at the same angular velocity by the magnetism of the permanent magnets 177. When there is a shock (transitional load fluctuation) generated by the recording medium entering the nip formed by the driving roller 4 and the countering roller 8 (FIG. 1), since the magnetic flywheel 175 has great moment of inertia and it is freely rotating, it tends to maintain the angular velocity, the relative velocity occurring between the magnetic flywheel 175 and the magnetic rotating member 176 due to the transitional rotation change by the shock of the magnetic rotating member 176 is reduced by the damping effect of the magnetism of the permanent magnets 177. As a result, the peak value of the transitional rotation change is reduced. Furthermore, the magnetic flywheel 175, the magnetic rotating member 176, and the permanent magnets 177 function to stabilize the vibration of the stepping motor.

Although the permanent magnets 177 are attached to the magnetic rotating member 176 according to this modification, the permanent magnets 177 may be attached to the magnetic flywheel 175 to obtain the same result.

Figure 18:
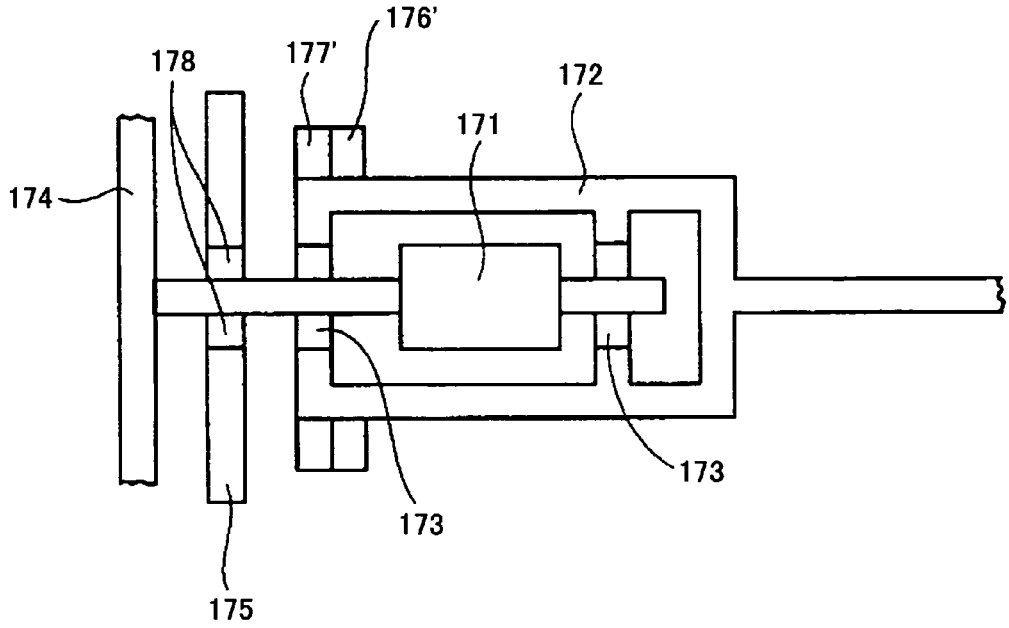
FIG. 18 is a schematic diagram of a modification example of a shock relief mechanism according to Embodiment 2.

A modification of the shock relief mechanism of Embodiment 2 is described with reference to FIG. 18.

The modification includes a magnetic rotating member 176', and a permanent magnet 177'. Other reference marks are common to FIG. 17.

Although illustration is omitted, on the right-hand side of the outer rotor 172, the driving roller, and so on are joined through the universal joint the same way as shown by FIG. 17.

The stator 171 is formed and fixed on the axle fixed to the side plate 174 that is fixed to the image formation apparatus. The outer rotor 172 is supported by the outer roller bearing 173 placed on the axle fixed to the side plate 174, and can be rotated by the rotating magnetic field generated by the stator 171. The magnetic rotating member 176' that is in the shape of a disk and the permanent magnet 177' are provided on the perimeter of the outer rotor 172, and are rotated. The magnetic flywheel 175 is arranged between the outer rotor 172 and the side plate 174 supported by the bearing 178.

The magnetic rotating member 176' and the permanent magnet 177' constitute the auxiliary mechanism to the magnetic flywheel 175.

While the driving roller (not illustrated) is rotating at a constant annular velocity, the magnetic rotating member 176' and the permanent magnet 177' also rotate at the constant angular velocity. Further, the magnetic flywheel 175 rotates at the constant angular velocity by the magnetism of the permanent magnet 177'. When a shock (transitional load fluctuation) is generated by the recording medium entering the nip formed by the driving roller 4 and the countering roller 8 (FIG. 1), the magnetic flywheel 175, which has great moment of inertia and is freely rotating, tends to maintain the constant angular velocity, while a transitional rotation change occurs at the magnetic rotating member 176'. Accordingly, there arises a relative velocity between the magnetic flywheel 175 and the magnetic rotating member 176'. The damping effect of the magnetism of the permanent magnet 177' reduces the relative speed. As a result, the peak value of the transitional rotation change is reduced. Furthermore, the magnetic flywheel 175, the magnetic rotating member 176', and the permanent magnet 177' constitute the auxiliary mechanism, and function to stabilized the vibration of the stepping motor.

According to the present modification, the permanent magnet 177' is attached to the magnetic rotating member 176'; nevertheless, the effect is obtained by arranging a permanent magnet to the magnetic flywheel 175. Further, the magnetic rotating member 176' does not have to be placed on the perimeter of the outer rotor 172, but it can be attached on a side (on the left-hand side according to the present case) of the outer rotor 172.

Another example of modification of the shock relief mechanism of Embodiment 2 is described with reference to FIG. 19.

This modification example includes a supporting member 191, a bearing 192, a non-magnetic member 193, a magnetic member 195, a magnetic flywheel 196, and a permanent magnet 197.

Figure 19:
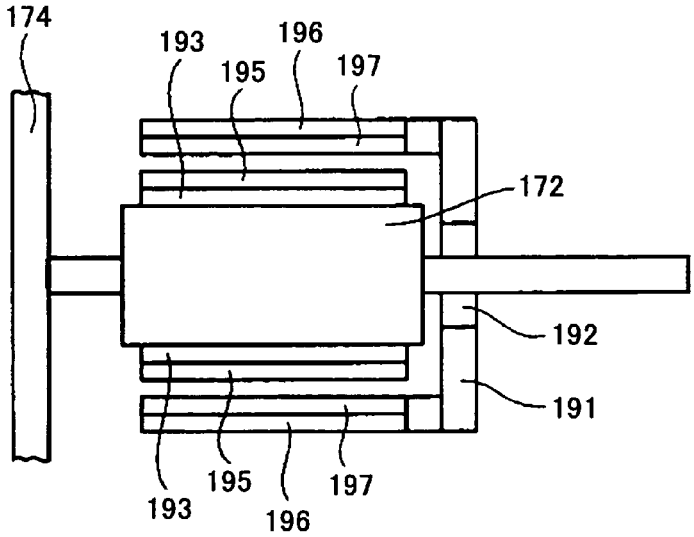
FIG. 19 is a schematic diagram of another modification example of the shock relief mechanism according to Embodiment 2.

Although inside of the outer rotor 172 is not detailed in FIG. 19, there is a stator, which is similar to the stator 171, in the outer rotor 172. The stator is formed and fixed on the axle that is fixed to the side plate 174 of the image formation apparatus. The outer rotor 172 is supported by an outer roller bearing (not shown) that is placed on the axle fixed to the side plate 174, and can be rotated by the rotating magnetic field generated by the stator. The outer rotor 172 is joined to a driving roller (not illustrated) on the rotation axle of the stepping motor through a universal joint (not illustrated), the rotation axle being in one body with the outer rotor 172. Further, the non-magnetic member 193, which is shaped like a cylinder, and the magnetic member 195, which is shaped like a cylinder, are arranged on the perimeter of the outer rotor 172, and are rotated in one body with the outer rotor 172. The non-magnetic member 193 is arranged in order to lessen magnetic interference between a magnetic circuit of the stepping motor and the dumping mechanism of the magnetic member. Further, the bearing 192, the magnetic flywheel 196 in the shape of a cylinder that freely rotates supported by the supporting member 191, which is shaped like a disk, and the permanent magnet 197 in the shape of a cylinder attached to the magnetic flywheel 196 are arranged on the rotation axle of the stepping motor that rotates in one body with the outer rotor 172. The magnetic member 195 and the permanent magnet 197 attached to the magnetic flywheel 196 constitute the auxiliary mechanism.

Since the magnetic member 195 and the non-magnetic member 193 on the perimeter of the outer rotor 172 rotate at the same angular velocity as the driving roller (not illustrated), the magnetic flywheel 196 also rotates at the same angular velocity due to the magnetism of the permanent magnet 197. When there is a shock (transitional load fluctuation) generated by the recording medium entering the nip formed by the driving roller 4 and the countering roller 8 (FIG. 1), the magnetic flywheel 196 that has great moment of inertia and is freely rotating tends to maintain the same angular velocity, while the magnetic member 195 is affected by the transitional rotation change generated by the shock. That is, a relative velocity arises between the magnetic flywheel 196 and the magnetic member 195. Since the relative velocity is reduced by the damping effect of the magnetism of the permanent magnet 197, the peak value of the transitional rotation change is reduced as a result. Furthermore, the magnetic member 195, the magnetic flywheel 196, and the permanent magnet 197 constitute the auxiliary mechanism for stabilizing vibration of the stepping motor.

Although the permanent magnet 197 is attached to the magnetic flywheel 196 according to the present modification, the same effect is obtained by attaching the permanent magnet 197 to the magnetic member 195.

A configuration dispensing with the non-magnetic member 193 and the magnetic member 195 on the perimeter of the outer rotor 172 is possible, leaving the magnetic flywheel 196 that freely rotates through the supporting member 191 and the bearing 192 on the rotation axle of the stepping motor that rotates in one body with the outer rotor 172. In this case, the stepping motor can be one of a PM type using a permanent magnet and a HB (hybrid) type using magnetic flux leaking (emanating) from the rotor.

While a driving roller (not illustrated) is rotating at a constant angular velocity, the magnetic flywheel 196 also rotates at the constant angular velocity due to the magnetism of the outer rotor 172. When there is a shock (transitional load fluctuation) generated by the recording medium entering the nip formed by the driving roller 4 and the countering roller 8 (FIG. 1), the magnetic flywheel 196 tends to maintain the angular velocity due to its great moment of inertia and it freely rotates. On the other hand, a transitional rotation change occurs at the outer rotor 172 due to the shock. Accordingly, relative velocity arises between the magnetic flywheel 196 and the outer rotor 172. The relative velocity is reduced by the damping effect of the leaking magnetism from the outer rotor 172, and the peak value of the transitional rotation change is reduced as a result.

In the following, Embodiment 3 of the present invention is described. First, the basic principle of a shock absorber mechanism, which is one of the shock relief mechanisms used by Embodiment 3, is described with reference to FIGS. 20A and 20B. A state before an object 201 collides with a fixed object 202 is shown in FIG. 20A, and a state after the object 201 collides with the fixed object 202 is shown in FIG. 20B.

Figure 20A:
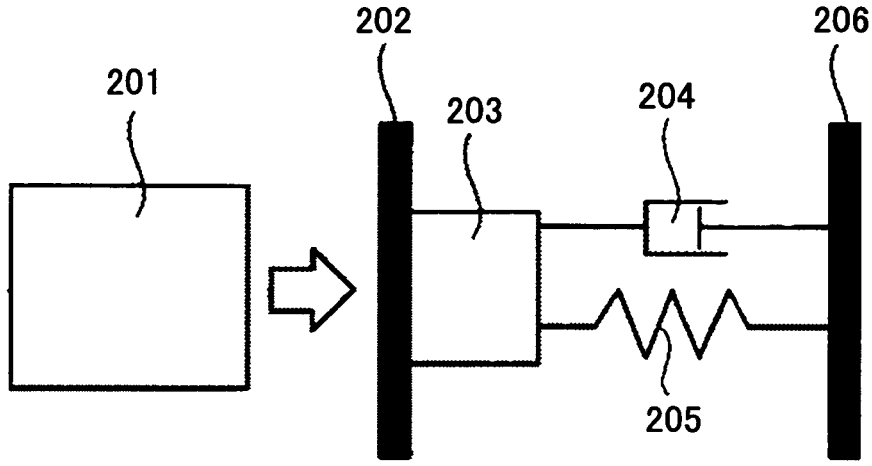
FIG. 20A and FIG. 20B are schematic diagrams showing the basic principle of a shock absorber mechanism that is one of the shock relief mechanisms used by Embodiment 3.
Figure 20B:
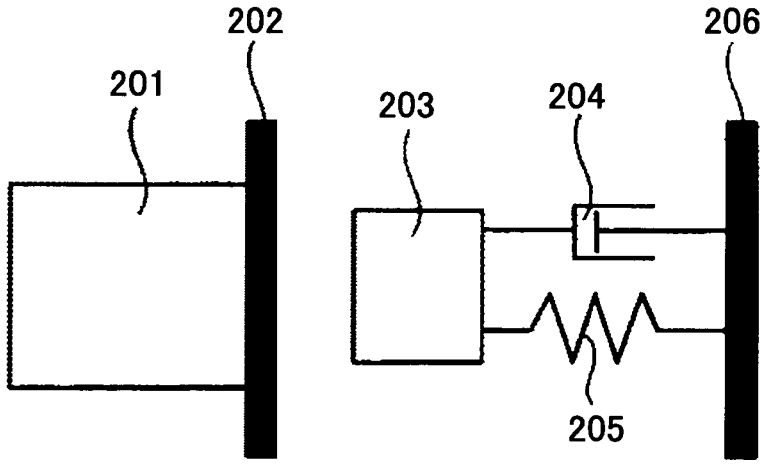

FIGS. 20A and 20B further show a shock absorbing unit 203, a damping mechanism 204, a spring mechanism 205, and a fixing part 206.

According to Embodiment 3, rotation change of the driving roller due to the transitional load fluctuation generated by the recording medium entering the nip formed by the driving roller 4 and the countering roller 8, while the driving roller is rotationally driven at a constant angular velocity by the stepping motor, is reduced by increasing the torque of the stepping motor according to the transitional load fluctuation; and an apparatus with the shock absorber mechanism is provided so that the shock and vibration by the transitional load fluctuation is dumped and reduced.

As shown in FIG. 20A, the shock absorbing unit 203, which is an inertial mass unit, is affixed to the fixing part 206 through the damping mechanism 204 and the spring mechanism 205 in parallel. The shock absorbing unit 203 touches the fixed object 202 by spring force of the spring mechanism 205. Here, the object 201 having momentum moves toward the fixed object 202. The state after the object 201 collides the fixed object 202 is shown by FIG. 20B. The magnitude of the momentum of the object 201 is expressed by mv, where m represents mass of the object 201, and v represents its speed. After the collision, the momentum is transmitted to the shock absorbing unit 203 through the fixed object 202, the magnitude of the transmitted momentum being expressed by m'v', where m' is mass of the shock absorbing unit 203, and v' is a speed of the shock absorbing unit 203. Under this situation, if time during which pressing force due to the collision is applied to the fixed object 202 is zero, $mv-m'v'=0$. That is, all the momentum of the object 201 is transferred to the shock absorbing unit 203. Accordingly, the fixed object 202 does not move at all with no oscillation or vibration occurring. The momentum of the object 201 is fully transferred to the shock absorbing unit 203. The momentum of the shock absorbing unit 203 is decreased by the damping mechanism 204 and the spring mechanism 205 that are provided between the shock absorbing unit 203 and the fixing part 206. When the shock absorbing unit 203 returns to touch the fixed object 202 by the spring force, the shock at this time is reduced by the damping mechanism, that is, it softly touches.

Figure 21B:
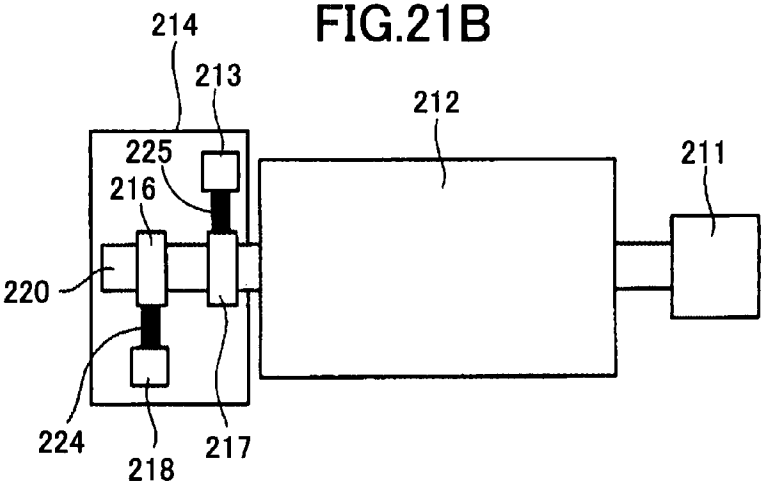
FIG. 21B is a side view of the mechanism according to Embodiment 3.
Figure 21A:
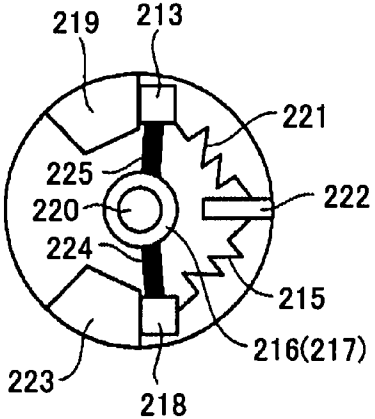
FIG. 21A is a front view of a mechanism according to Embodiment 3.
Figure 21C:
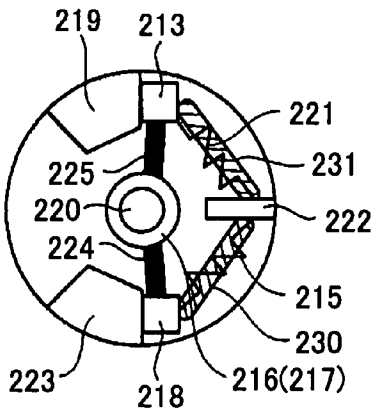
FIG. 21C is a front view of a modification of the mechanism according to Embodiment 3.

Embodiment 3 and its modification are described with reference to FIGS. 21A, 21B, and 21C. FIG. 21A is a front view, and FIG. 21B is a side view of a shock absorber mechanism of Embodiment 3. FIG. 21C is a front view of a modification of Embodiment 3.

The configuration of Embodiment 3 includes a stepping motor 211, a driving roller 212, a first shock absorbing unit 213, a housing 214, a spring 215, outer rotor bearings 216 and 217, a second shock absorbing unit 218, a contacting unit 219, an extended axle 220, a spring 221, a spring supporting unit 222, a contacting unit 223, supporting members 224 and 225, and buffer mechanisms 230 and 231.

Embodiment 3 uses two shock absorber mechanisms, the basic principle of which has been described referring to FIGS. 20A and 20B, such that a shock in a rotational direction and another shock in the reverse rotational direction may be absorbed.

To the rotational axle of the stepping motor 211 that serves as a driving source, one end of the driving roller 212 is joined through a not illustrated universal joint.

The extended axle 220 is arranged at another end of the driving roller 212. The housing 214 is arranged such that it rotates in one body with the extended axle 220. In the housing 214, the contacting unit 219, the spring supporting unit 222, and the contacting unit 223 are arranged. Further, on the extended axle 220 the outer roller bearings 216 and 217 are arranged. The supporting members 224 and 225 are supported by bearings 216 and 217, respectively. Further, the shock absorbing units 218 and 213 are attached to the supporting members 224 and 225, respectively. The shock absorbing units 218 and 213 can freely rotate around the bearings 216 and 217, respectively.

One end of the spring 215 is joined to the shock absorbing unit 218, and the other end of the spring 215 is joined to the spring supporting unit 222. Similarly, one end of the spring 221 is joined to the shock absorbing unit 213, and the other end of the spring 221 is joined to the spring supporting unit 222. The shock absorbing unit 218 is pressed to the contacting unit 223 by the spring 215, and the shock absorbing unit 213 is pressed to the contacting unit 219 by the spring 221.

Further, the interior of the housing 214 is filled with a viscous member such as silicon for providing a damping effect to a transitional change of the shock absorbing unit 213 and the shock absorbing unit 218. Alternatively, a buffer mechanism, such as a dash pot or rubber, may be provided in parallel with the spring 221 and the spring 215.

FIG. 21C shows an example that includes the buffer mechanism in addition to the mechanism shown in FIG. 21A.

A rubber buffer mechanism 230 is provided in parallel with the spring 215, and a rubber buffer mechanism 231 is provided in parallel with the spring 221, the rubber buffer mechanisms 230 and 231 serving as damping mechanisms. A transitional change of the shock absorbing units 213 and 218 is reduced by the damping effect of the rubber buffer mechanisms 230 and 231. With the configuration described above, the housing 214 is not necessarily required to provide airtightness for containing the viscous member, such as silicon.

When there is a shock (transitional load fluctuation) generated by the recording medium entering the nip formed by the driving roller 4 and the countering roller 8 (FIG. 1), the driving roller 212 receives transitional momentum, which is different from steady state, due to the shock. The momentum is transmitted to the shock absorbing unit 213 and the shock absorbing unit 218 through the contacting unit 219 and the contacting unit 223, respectively. The momentum of the shock absorbing unit 213 and the shock absorbing unit 218 is absorbed by the spring 221 and the spring 215, respectively. Further, the shock absorbing unit 213 and the shock absorbing unit 218 slowly return to touch the contacting unit 219 and the contacting unit 223, respectively, by the damping effect of the viscous material and/or the rubber damping mechanisms. As a result, the peak value of the transitional rotation change is reduced.

By using the flywheel, the magnetic flywheel, etc., the shock absorber mechanism as described above further reduces vibration of the stepping motor, reduces the transitional load fluctuation by the shock, and provides prompt damping of the vibration.

Figure 38:
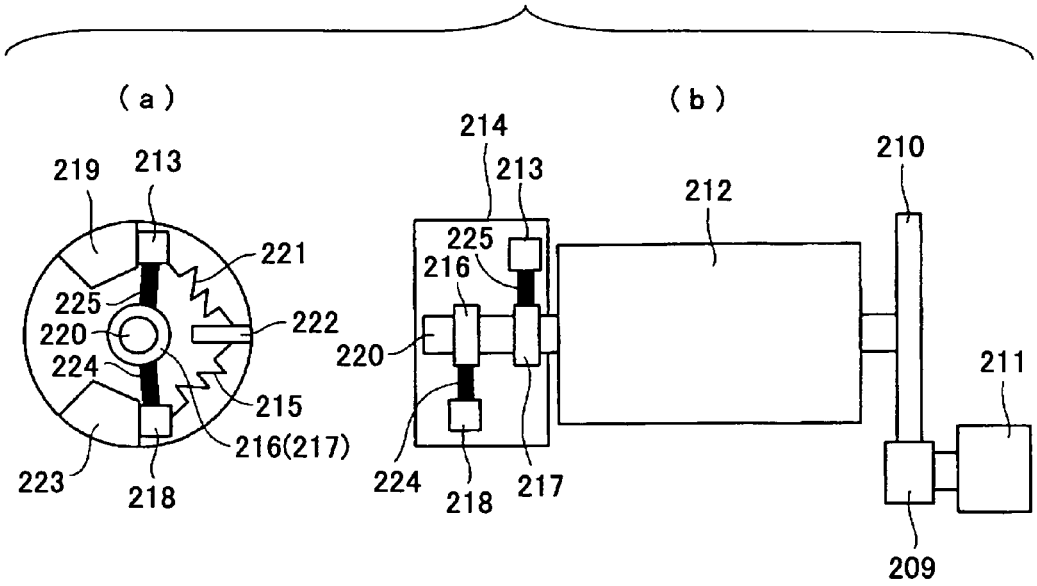
FIG. 38 gives a front view and a side view of a modification of Embodiment 3.

A modification of Embodiment 3 is described with reference to FIG. 38, which gives a front view and a side view of a shock absorber mechanism according to the modification.

The present modification includes a driving gear 209, and a follower gear 210.

The driving gear 209 is arranged such that it shares the rotational axle with the stepping motor 211, which serves as a driving source. The driving gear 209 and the follower gear 210 are in meshing engagement such that driving force is transmitted. The follower gear 210 shares the same rotational axle with the driving roller 212 through a universal joint that is not illustrated here. The extended axle 220 is arranged at the end of the driving roller 212. The housing 214 is arranged such that it rotates in one body with the extended axle 220. The housing 214 includes the fixed part contacting unit 219, the spring supporting unit 222, and the contacting unit 223. The outer roller bearings 216 and 217 are arranged on the extended axle 220. The supporting members 224 and 225 are arranged to the outer roller bearings 216 and 217, respectively. Furthermore, the shock absorbing unit 218 and the shock absorbing unit 213 are arranged on the supporting members 224 and 225, respectively. In this way, the shock absorbing unit 218 and the shock absorbing unit 213 can freely rotate with the bearings 216 and 217, respectively.

One end of the spring 215 is attached to the shock absorbing unit 218, and the other end of the spring 215 is fixed to the spring supporting unit 222. Similarly, one end of the spring 221 is attached to the shock absorbing unit 213, and the other end of the spring 221 is fixed to the spring supporting unit 222. The shock absorbing unit 218 is pressed to the contacting unit 223 by the spring 215, and the shock absorbing unit 213 is pressed to the contacting unit 219 by the spring 221.

Further, the interior of the housing 214 is filled with a viscous member, such as silicon such that a damping effect over a transitional change of the shock absorbing unit 213 and the shock absorbing unit 218 is obtained. Further, a damping mechanism, such as a dash pot or rubber, may be alternatively provided in parallel with the spring 221 and the spring 215.

The modification as described above with reference to FIG. 21C can be applied to this configuration.

According to the configuration described above, the same effect as in Embodiment 3 (FIG. 21) can be acquired.

Further, by using the usual flywheel, the magnetic flywheel, etc., as described above, vibration of the stepping motor can be reduced, the transitional load fluctuation due to the shock can be reduced, and the shock absorber mechanism can promptly damp the vibration.

Figure 22:
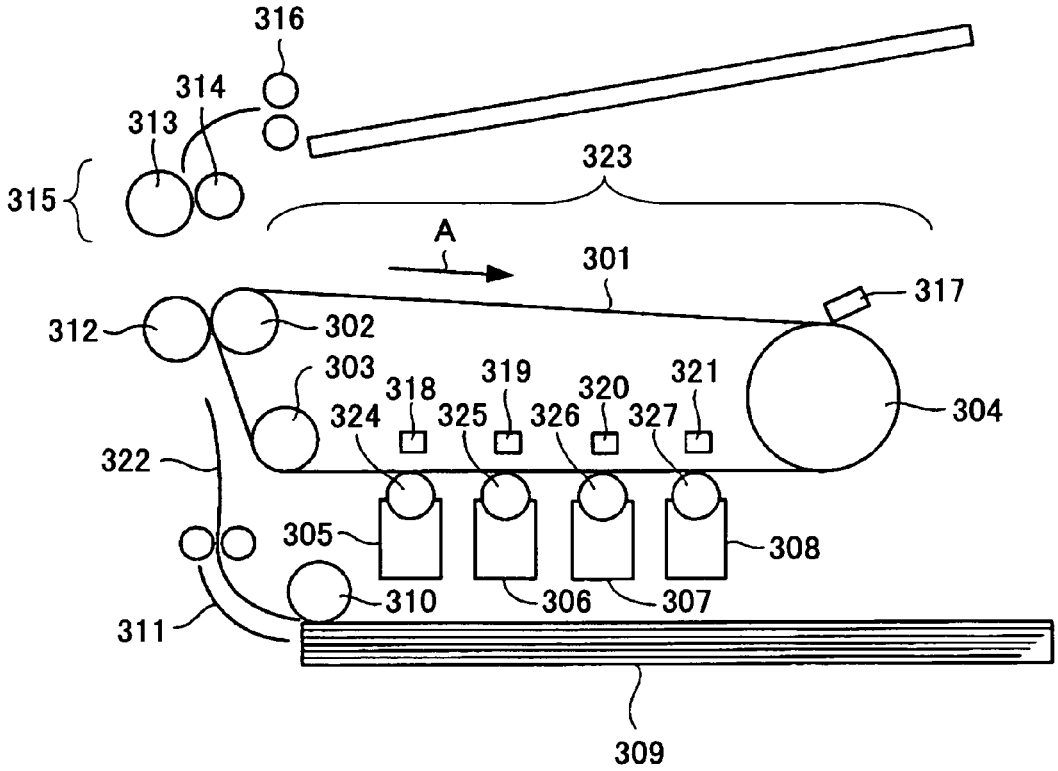
FIG. 22 is a schematic diagram of an example of an image formation apparatus according to an embodiment of the present invention.

Next, an example of the image formation apparatus of the present invention is described with reference to FIG. 22.

The image formation apparatus includes a middle imprint belt 301, a driving roller 302, a follower roller 303, and a countering roller 304. Other items and associated reference numbers are directly referred to in the following description.

This is an example where the image formation apparatus is a color copying machine. The middle imprint belt 301 is an image supporting member that is of a closed loop made of PI base material. The middle imprint belt 301 is wound around and supported by three rollers, namely, the driving roller 302 driven by a driving motor (not illustrated) for driving the middle imprint belt 301, the countering roller 304 for providing tension to the middle imprint belt 301, and the follower roller 303. The middle imprint belt 301 is rotated in the direction of arrow A.

A middle imprint unit 323, including the middle imprint belt 301, further includes:

photo conductor drums 324 through 327 for corresponding colors of black, yellow, magenta, and cyan;

photo conductor drum units 305 through 308 each including an electrification unit, an exposing optical system serving as an exposing unit, and a development unit;

imprint units 318 through 321, to which an imprint bias is applied;

a secondary imprint roller 312 for imprinting to recording media (recording medium); and a middle imprint belt cleaning unit 317 made of such as rubber and formed in the shape of a blade.

The exposing optical system modulates a laser beam generated by a semiconductor laser, e.g., by intensity modulation and pulse-width modulation according to an image signal for each color, and an exposure light is obtained. The exposure light scans the photo conductor drums 324 through 327, and electrostatic latent images corresponding to the image signals of the corresponding colors are formed one by one on the photo conductor drums 324 through 327. Further, each development unit contains toner corresponding to a development color. According to timing of the electrostatic latent images corresponding to the image signals for the colors on the photo conductor drums 324 through 327, the electrostatic latent images are developed with the corresponding toners. The developed images are superposed to produce a full color image. The full color image is imprinted on the middle imprint belt 301 from the photo conductor drums 324 through 327 by applying the imprint bias to the imprint units 318 through 321 formed on a side of the middle imprint belt 301, the side being opposite to a side where the photo conductor drums 324 through 327 are arranged. Further, the middle imprint belt cleaning unit 317 contacts the middle imprint belt 301 so as to remove residual toner from the middle imprint belt 301. The recording media are provided, one sheet at a time, by a feed roller 310 from a recording medium cassette 309 to a form conveyance way 311. The secondary imprint roller 312 imprints the full color image from the middle imprint belt 301 onto the recording medium with the imprint bias being applied to the secondary imprint roller 312.

A fixing unit 315 includes a heating roller 313 containing a heat source and a pressing roller 314 that sandwich the recording medium on which the full color image is imprinted, thereby applying heat and pressure to the recording medium so that the full color image is fixed to the recording medium.

In the following, operations of the example as above are described, wherein the electrostatic latent images are developed in the order of black, cyan, magenta, and yellow, for example.

As for the black color, the photo conductor drum 327 is driven by the driving source (not illustrated), a voltage of several kV is provided to the electrification unit of the photo conductor drum unit 308 by a power supply unit (not illustrated), and the surface of the photo conductor drum 327 is uniformly charged at a voltage of hundreds V. The exposure light of the laser beam corresponding to the image signal for the black color is irradiated onto the photo conductor drum 327 by the exposing optical system. The charge of the portion of the photo conductor drum 327 irradiated by the exposure light is discharged and an electrostatic latent image is formed.

On the other hand, the development unit for black color (black development unit) contacts the photo conductor drum 327 at a predetermined timing. The black toner that is beforehand negatively charged adheres only to the discharged portion (electrostatic latent-image portion) of the photo conductor drum 327, and the so-called negative positive development process is performed. The black toner image formed on the surface of the photo conductor drum 327 by the black development unit is next imprinted from the photo conductor drum 327 to the middle imprint belt 301 while the imprint bias is applied to the imprint unit 321, where the photo conductor drum 327 contacts the middle imprint belt 301. Toner not used for imprinting that remains on the middle imprint belt 301 is removed by a photo conductor cleaning unit (not illustrated). Further, the charge on the photo conductor drum 327 is removed by an electric discharging unit (not illustrated).

The images of other colors, namely, cyan, magenta, and yellow formed on the corresponding photo conductor drums are similarly processed. Then, the three images are piled (superposed) on the black image one by one.

The 4-color full color image formed on the middle imprint belt 301 is conveyed to an imprint section formed by the driving roller 302 and the secondary imprint roller 312. A voltage of several kV is provided to the secondary imprint roller 312 from the power supply unit such that the full color image is imprinted onto the recording medium that is conveyed to the imprint section through the form conveyance path 311 from the recording medium cassette 309.

Then, the recording medium is conveyed to the fixing unit 315, where the full color image is fixed by pressure generated by the heating roller 313 and the pressing roller 314, and by heat provided by the heating roller 313. Then, the recording medium is discharged by a delivery roller 316 to a delivery tray.

Residual toner on the middle imprint belt 301 is removed by the middle imprint belt cleaning unit 317. The middle imprint belt cleaning unit 317 is in contact with the middle imprint belt 301, and removes the residual toner not used for imprinting that remains. Full color image formation for one sheet is completed by the series of operations as described above.

With the color copying machine as described above, a transitional load fluctuation due to the recording medium entering the imprint section greatly affects the precision of the superposition of the four colors in image formation. Accordingly, high precision driving of especially the middle imprint belt 301 is desired.

Then, according to an embodiment of the present invention, the middle imprint belt 301 is driven by a driving unit as shown in one of FIG. 1 and FIG. 15, to which one of Embodiments 1, 2, and 3 is applied.

In this way, even if the transitional load fluctuation occurs when the recording medium enters the imprint section, the transitional load fluctuation transmitted to the middle imprint belt is reduced, so that highly precise paper conveyance driving can be performed, and a high quality image can be obtained.

Figure 23:
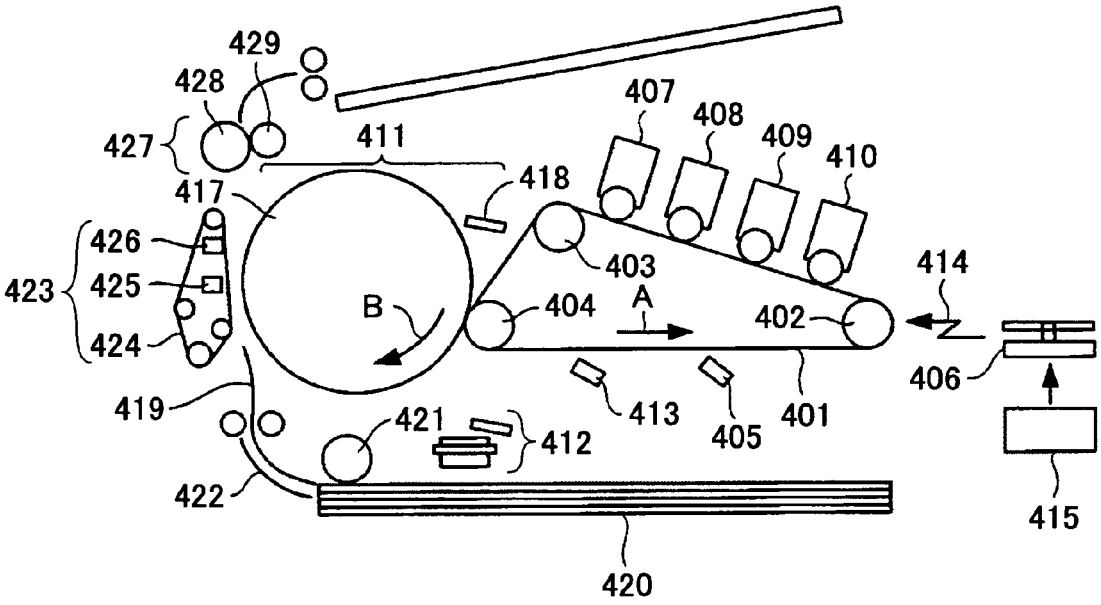
FIG. 23 is a schematic diagram of another example of an image formation apparatus according to an embodiment of the present invention.

Another example of the image formation apparatus, to which the present invention is applied, is described with reference to FIG. 23.

The image formation apparatus includes:

a photo conductor 401 serving as an image supporting member;

photo conductor conveyance rollers 402, 403, and 404;

an electrification unit 405;

an exposing optical system (LSU) 406;

development units 407, 408, 409, and 410;

a middle imprint unit 411;

an imprint drum 417; and a middle belt 424. Other items and associated reference numbers are directly referred to in the following description.

The image formation apparatus of this example is a color copying machine. The photo conductor 401 is a photo conductor belt that constitutes a closed loop. On an outer side of the photo conductor belt, an optically sensitive layer, such as a thin film of an organic photo semiconductor (OPC), is formed. The photo conductor 401 is wound around and supported by the photo conductor conveyance rollers 402, 403, and 404; and is rotated in the direction of arrow A by a driving motor (not shown).

Around the photo conductor 401 are arranged the electrification unit 405, the LSU 406, the development units 407 through 410 for colors of black, yellow, magenta, and cyan, respectively, the middle imprint unit 411, a photo conductor cleaning unit 412, and an electric discharging unit 413 in this order in the rotational direction of the photo conductor 401 as shown by the arrow A. A high voltage of several kV is provided to the electrification unit 405 by a power supply unit (not illustrated) such that the portion of the photo conductor 401 countering the electrification unit 405 is uniformly charged.

A laser driving circuit (not shown) of the LSU 406 generates a modulation signal by sequentially modulating an image signal in each color received from a gradation conversion unit (not shown), by one of intensity modulation and PDM, and generates an exposure light 414 by driving a semiconductor laser (not shown) by the modulating signal. The photo conductor 401 is scanned with the exposure light 414 such that an electrostatic latent image corresponding to the image signal in each color is arranged one by one on the photo conductor 401.

The development units 407 through 410 contain toners corresponding to the development colors, selectively contact the photo conductor 401 at timings according to the electrostatic latent image corresponding to the image signal in each color on the photo conductor 401, and develop the electrostatic latent images on the photo conductor 401 with the corresponding toners. Then, the images in each color are superposed to form a full color image.

The middle imprint unit 411 includes an imprint drum 417 serving as a middle imprint object. The imprint drum (middle imprint object) 417 includes a cylindrical member of metal, such as aluminum, on the surface of which metal cylinder a belt-like sheet made of, e.g., conductive resin is wound. The middle imprint unit 411 further includes a middle imprint object cleaning unit 418 that is made of, e.g., rubber and formed in the shape of a blade. While the images in four colors are being superposed on the middle imprint object 417, the middle imprint object cleaning unit 418 is apart from the middle imprint object 417. The middle imprint object cleaning unit 418 contacts the middle imprint object 417 only when cleaning the middle imprint object 417. Then, residual toner that remains on the middle imprint object 417 without having been imprinted onto the recording medium 419 is removed. One sheet of recording medium is fed at a time to a form conveyance way 422 with a feed roller 421 from a recording medium cassette 420.

The imprint unit 423 serving as imprint means imprints the full color image onto the recording medium 419 from the middle imprint object 417. The imprint unit 423 includes:

an imprint belt 424 formed by, e.g., conductive rubber in the shape of a belt;

an imprint bias unit 425 for providing an imprint bias to the middle belt 424 for imprinting the full color image carried by the middle imprint object 417 onto the recording medium 419; and a separator 426 for providing a bias to the middle imprint object 417 so that the recording medium 419 may be prevented from electrostatically sticking to the middle imprint object 417 after the full color image has been imprinted on the recording medium 419.

The image formation apparatus according to the present example includes a fixing assembly 427. The fixing assembly 427 includes a heating roller 428 that has a heater inside, and a pressing roller 429. The recording medium 419 carrying the full color image passes between the heating roller 428 and the pressing roller 429, and is heated and pressed such that the full color image is fixed to the recording medium 419.

Operations of the image formation apparatus of the present example are described. Here, it is supposed that the development of the electrostatic latent images is performed in the order of black, cyan, magenta, and yellow.

The photo conductor 401 and the middle imprint object 417 are driven in directions indicated by arrows A and B, respectively, by corresponding driving sources (not shown). A high voltage of several kV is provided to the electrification unit 405 by a power supply unit (not shown). The electrification unit 405 uniformly charges the surface of the photo conductor 401 at several hundreds of V. The exposure light 414 of the laser beam corresponding to the image signal for black color is irradiated onto the photo conductor 401 by the LSU 406. The portion of the photo conductor 401 irradiated by the exposure light 414 is discharged and an electrostatic latent image is formed.

The development unit 407, which is for the black color, contacts the photo conductor 401 at a predetermined timing. A black toner, which is beforehand negatively charged, adheres only to the discharged portion (electrostatic latent image portion) of the photo conductor 401, and a black toner image is formed on the photo conductor 401. That is, development by the so-called negative positive process is performed. The black toner image formed on the surface of the photo conductor 401 by the black development unit 407 is imprinted onto the middle imprint object 417. Residual toner that has not been transmitted to the middle imprint object 417 from the photo conductor 401 is removed by the photo conductor cleaning unit 412, and the charge on the photo conductor 401 is removed by the electric discharging unit 413.

Next, the electrification unit 405 uniformly charges the surface of the photo conductor 401 at several hundreds V. The exposure light 414 of the laser beam corresponding to the image signal in the cyan color is irradiated onto the photo conductor 401 by the LSU 406, the charge of the portion of the photo conductor 401 that is irradiated by the exposure light 414 is discharged, and an electrostatic latent image for the cyan color is formed.

Subsequently, like the case of the black color, a cyan toner image is formed on the photo conductor 401, and is imprinted onto the middle imprint object 417. Cleaning and so on of the photo conductor 401 is similarly performed.

Further, a magenta toner image and a yellow toner image are similarly formed on the photo conductor 401 such that the images in four colors are piled up on the middle imprint object 417.

The imprint unit 423 that has been apart from the middle imprint object 417 contacts the middle imprint object 417, a high voltage of several kV is provided to the imprint bias unit 425 from a power supply unit (not shown), and the full color image formed on the middle imprint object 417 is imprinted by the imprint bias unit onto the recording medium 419 conveyed along the form conveyance way 422 from the recording medium cassette 420.

A voltage is provided to a separator 426 from the power supply unit so that the electrostatic force attracts the recording medium 419, and the recording medium 419 is separated from the middle imprint object 417. Then, the recording medium 419 is conveyed to the fixing assembly 427, where the full color image is fixed by the heat provided by the heating roller 428 and pressure generated by the pressing roller 429 and the heating roller 428. Then, the recording medium 419 is discharged to a delivery tray 431 by a delivery roller 430.

Further, residual toner that remains on the middle imprint object 417 that has not been imprinted by the imprint unit 423 onto the recording medium 419 is removed by the middle imprint object cleaning unit 418. The middle imprint object cleaning unit 418 is separated from the middle imprint object 417 until the full color image is formed. The middle imprint object cleaning unit 418 contacts the middle imprint object 417, after the full color image is imprinted on the recording medium 419, for removing residual toner from the middle imprint object 417. Formation of the full color image for one sheet is completed by the series of operations described above.

A transitional load fluctuation generated by the recording medium entering the imprinting section of the color copying machine greatly influences the precision of superposing the toner images in the four colors in subsequent image formation. For this reason, high precision driving of especially the image supporting member 401, the imprint drum 417, and the middle belt 424 is desired.

In this view, according to the present example, the driving of the image supporting member 401, the imprint drum 417, and the middle belt 424 is performed by the driving gear as shown in one of FIG. 1 and FIG. 15, to which driving gear, one of the Embodiments 1, 2, and 3 is applied. In this way, even if the transitional load fluctuation due to the recording medium entering the imprint section occurs, the transitional load fluctuation received by the middle imprint belt is reduced, highly precise paper conveyance driving can be performed, and a high quality image can be obtained.

Figure 24:
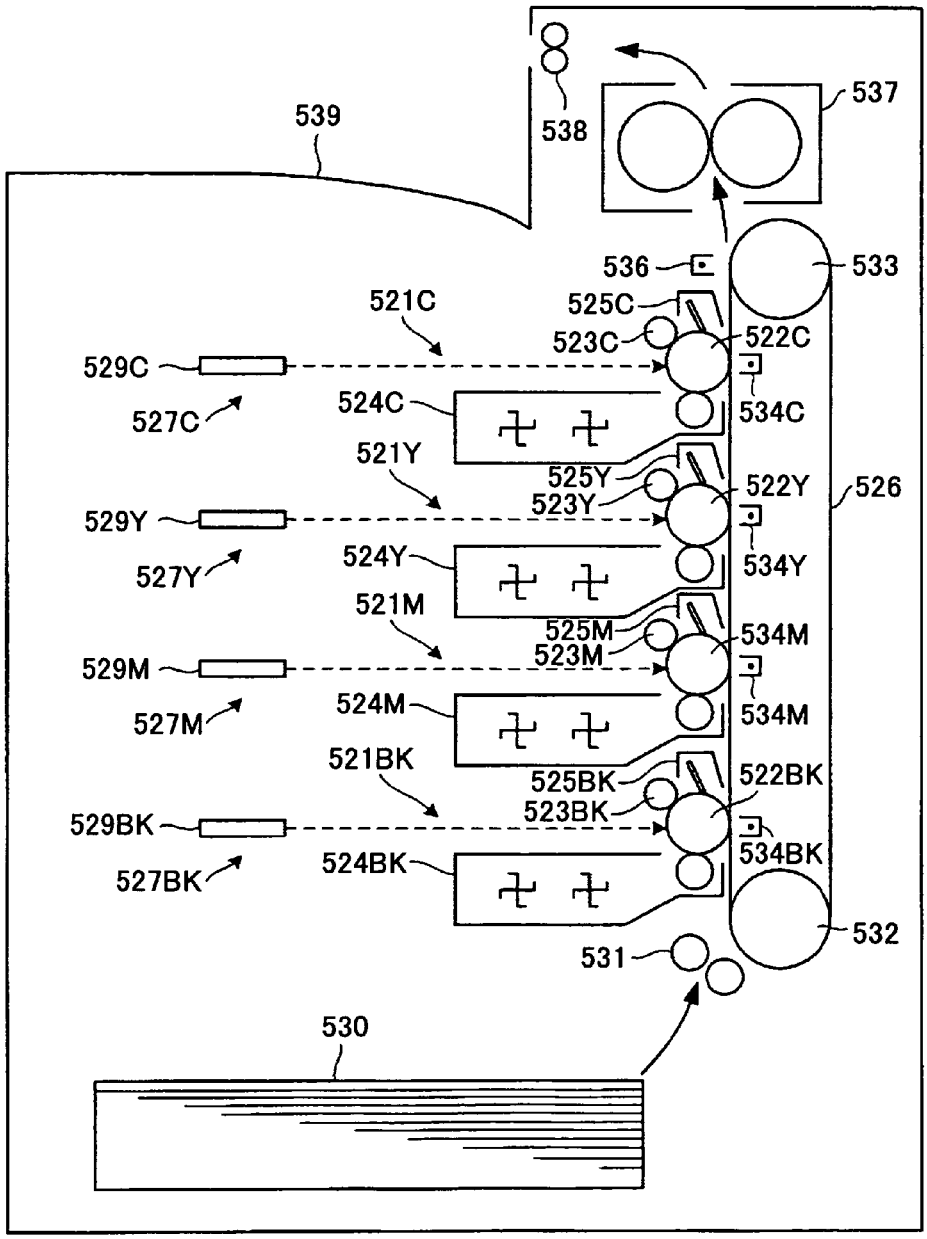
FIG. 24 is a schematic diagram of another example of an image formation apparatus according to an embodiment of the present invention.

Another example of the image formation apparatus according to the present invention is described with reference to FIG. 24.

The image formation apparatus includes an image formation unit 521, a photo conductor 522 serving as an image supporting member, an electrification apparatus 523, a development apparatus 524, a cleaning unit 525, and an optical writing unit 527 serving as exposure means.

The image formation apparatus of the present example is a tandem type image formation apparatus, wherein two or more image formation units 521Bk, 521M, 521Y, and 521C for forming images in black (Bk), magenta (M), yellow (Y), and cyan (C), respectively, are perpendicularly arranged. When the image formation units are collectively referred to, they are called 521Bk-C. The same reference naming system applies to other units. The image formation units 521Bk-C include corresponding photo conductors 522Bk-C made of drum-like photo conductors, corresponding electrification apparatuses (for example, contacting electrification apparatuses) 523Bk-C, corresponding development apparatuses 524Bk-C, and corresponding cleaning unites 525Bk-C.

The photo conductors 522Bk-C are perpendicularly arranged, countering a conveyance and direct imprint belt 526, which is an endless belt. The photo conductors 522Bk-C are rotationally driven by the conveyance and direct imprint belt 526. The photo conductors 522Bk-C are uniformly charged by the corresponding electrification apparatuses 523Bk-C, and exposed by corresponding optical writing apparatuses 527Bk-C such that corresponding electrostatic latent images are formed.

The optical writing apparatuses 527Bk-C include corresponding semiconductor laser drive circuits for driving corresponding semiconductor laser beams according to corresponding image signals for the colors Bk, M, Y, and C. The laser beams from the semiconductor lasers are deflected for scanning by corresponding polygon mirrors 529Bk-C. The laser beams from the polygon mirrors 529Bk-C are focused onto the corresponding photo conductors 522Bk-C through corresponding fθ lenses and mirrors that are not illustrated. In this way, the photo conductors 522Bk-C are exposed, and the corresponding electrostatic latent images are formed.

The electrostatic latent images on the photo conductors 522Bk-C are developed by the corresponding development apparatuses 524Bk-C, and turn into toner images in the colors of Bk, M, Y, and C. In this way, the electrification apparatuses 523Bk-C, the optical writing apparatuses 527Bk-C, and the development apparatuses 524Bk-C constitute image formation means to form the toner images of Bk, M, Y, and C on the corresponding photo conductors 522Bk-C.

A recording medium, such as regular paper and an OHP sheet, is stored in a lower part of the image formation apparatus. The recording medium is fed to a resist roller 531 along a recording medium conveyance way from a feed apparatus 530 including a feed cassette. The resist roller 531 sends out the recording medium to an imprint nip formed by the conveyance and direct imprint belt 526 and the photo conductor 522Bk at a timing that matches the toner image on the photo conductor 522Bk of the image formation unit 521Bk, which serves as the first image formation unit (image formation unit for imprinting a first image carried by the photo conductor on the recording medium).

The conveyance and direct imprint belt 526 is wound around the driving roller 532 and the follower roller 533, which rollers are vertically arranged. The driving roller 532 is rotated by a driving unit that is not illustrated. Then, the conveyance and direct imprint belt 526 is rotated at the same peripheral speed as the photo conductors 522Bk-C. The recording medium sent out from the resist roller 531 is conveyed by the conveyance and direct imprint belt 526. By the action of an electric field formed by the development apparatuses 524Bk-C, each of which includes a corona discharging unit, the toner images of Bk, M, Y, and C on the photo conductors 522Bk-C are piled (superimposed) one by one on the recording medium, which recording medium is electrostatically adhered to the conveyance and direct imprint belt 526. In this way, a full color image is formed, and the recording medium is firmly conveyed.

The charge of the recording medium is discharged by a separation unit 536 including a separation charger for discharging and for dissociating the recording medium from the conveyance and direct imprint belt 526. Then, the full color image is fixed by a fixing apparatus 537, and the recording medium is conveyed by a delivery roller 538 to a delivery unit 539 prepared in an upper part of the image formation apparatus. Further, the photo conductors 522Bk-C are cleaned by cleaning units 525Bk-C after imprinting the toner images to be ready for the next image formation operation.

A transitional load fluctuation due to the recording medium entering the imprint section greatly influences the quality of the final image on the conveyance and direct imprint belt 526 of the color copying machine. Accordingly, highly precise driving of the conveyance and direct imprint belt 526 is desired. Then, according to the present example, the driving of the conveyance and direct imprint belt 526 is performed by the driving gear that is configured as shown in FIG. 1 and FIG. 15 to which one of Embodiments 1, 2, and 3 is applied. In this way, even if the transitional load fluctuation due to the recording medium entering the imprint section occurs, the transitional load fluctuation transferred to the middle imprint belt can be reduced, highly precise paper conveyance driving can be performed, and a high quality image can be obtained.

Figure 25:
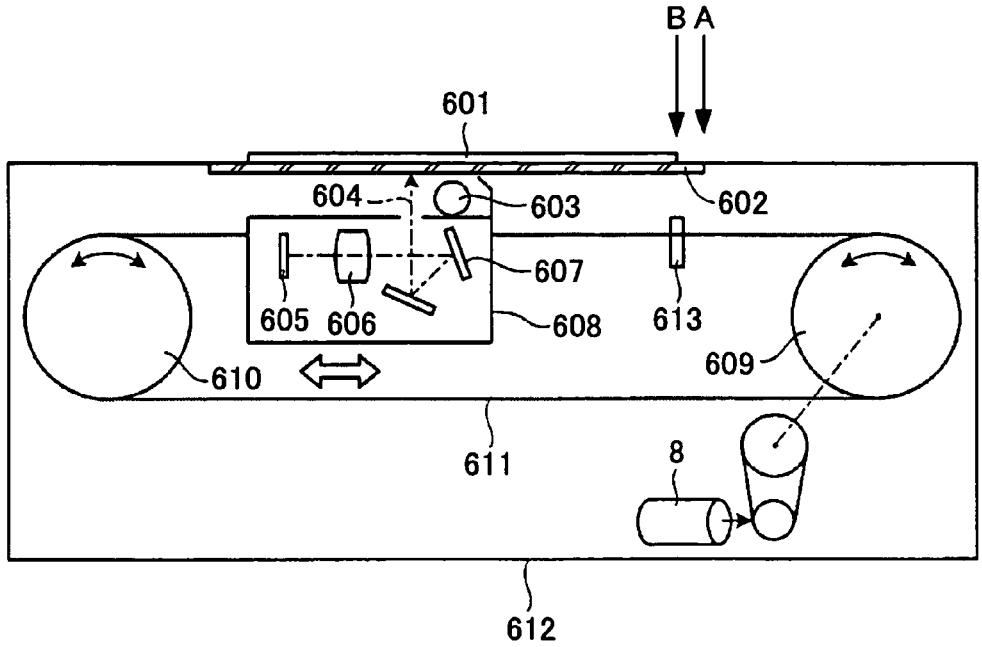
FIG. 25 is a schematic diagram of another example of an image formation apparatus according to an embodiment of the present invention.

Another example of the image formation apparatus to which the present invention is applied is described with reference to FIG. 25. The image formation apparatus shown in FIG. 25 includes:

a driving motor 8;
a manuscript 601 that is to be read;
a manuscript stand 602 for placing the manuscript;
a lighting system 603 for irradiating a light for reading the manuscript;
an optical path 604 of a reflected light;
a reading element 605;
an image-formation lens 606;
mirrors 607;
an photoelectric conversion unit 608 for reading the manuscript;
pulleys 609 and 610 for sub-scanning driving;
a wire 611; and
a housing 612 for containing items listed above.

This example is related to a driving gear to drive a running object of an image reader.

The photoelectric conversion unit 608 is driven in the sub-scanning direction of the manuscript 601 by the wire 611 that is wound around the pulleys 609 and 610, the pulley 609 being driven by the motor 8 that is fixed to the housing 612. At this time, the lighting system 603 that may be constituted by such as a fluorescent light illuminates the manuscript 601 on the manuscript stand 602, the reflected light (the optical path which is referred to as 604) is reflected by the mirrors 607, and the image of the manuscript 601 is formed on the reading element 605 that may be comprised by an optical receiving unit of an image sensor, such as CCD, through the image-formation lens 606. By scanning the whole surface of the manuscript 601 with the photoelectric conversion unit 608, the manuscript is read. Further, a sensor 613 for defining a reading start position B is provided. It is so designed that a moving speed of the photoelectric conversion unit 608 is raised to a uniform steady speed by the time it arrives at the reading start position B from a home position A. Reading is started when the photoelectric conversion unit 608 reaches the point B.

Then, according to the present example, the photoelectric conversion unit 608 is driven by the driving gear shown in FIG. 1 and FIG. 15 to which one of Embodiments 1, 2, and 3 is applied. In this way, the precision of driving the running object of the image reader is improved, and a high quality reading image can be obtained.

An ultrasonic motor can be used in place of the stepping motor. The principle of operations of the ultrasonic motor based on a progressive wave method is described with reference to FIG. 26.

Figure 26:
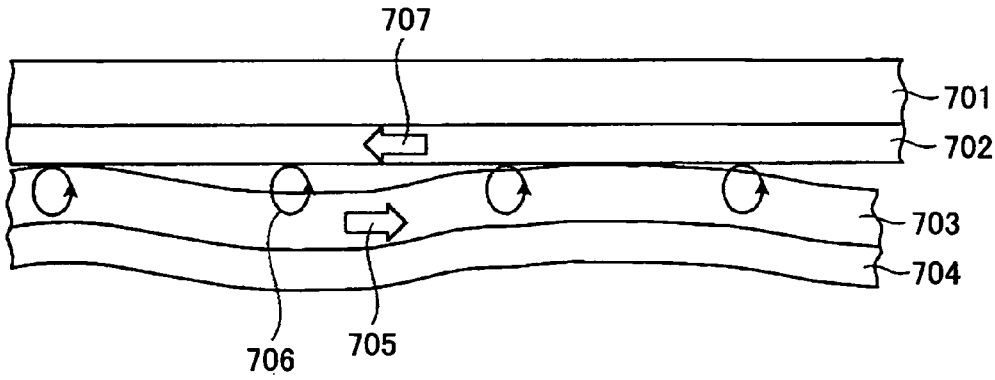
FIG. 26 is a schematic diagram showing the principle of operation of a progressive wave method ultrasonic wave motor.

The ultrasonic motor includes an elastic body 701; friction material 702; an elastic body 703; and a piezoelectric ceramic 704. In FIG. 26, a progressing direction of a wave of a vibrating object is indicated by 705; an ellipse locus is indicted by 706; and a progressing direction of a moving object is indicated by 707.

The piezoelectric ceramic 704 and the elastic body 703, such as metal, are stuck together to constitute the vibrating object. The moving object is constituted by the friction material 702 and the elastic body 701. The moving object contacts the vibrating object with pressure of a spring, and the like. The friction material 702 is for reducing friction, and it is desired that the friction material 702 be made of a material having a high rub resistance. The piezoelectric ceramic 704 has two driving electrodes (not illustrated), to which alternate voltages having a predetermined phase difference are provided. Then, the vibrating object generates a progressive wave of bending vibration, and a point of the surface of the vibrating object moves, thereby drawing the ellipse locus 706. The moving object contacts the vibrating object only at a wave front of the progressive wave, and is driven by friction according to the ellipse locus 706. Accordingly, the moving object moves in a direction opposite to the progressing direction of the progressive wave. The moving speed can be adjusted by changing the frequency of the alternate voltages. If the driving current is increased, since the amplitude of the progressive wave is increased, the frictional force and the driving torque are increased. The ultrasonic motor can be structured as an inner rotor type and an outer rotor type.

It is highly effective to use the ultrasonic motor that operates on the principle as described above instead of the stepping motor described in Embodiments of the present invention, given that its fundamental holding torque is great for it is driven by friction drive. That is, even if a transitional load fluctuation occurs when the recording medium enters the imprint section, transmission of the transitional load fluctuation to the driving roller is reduced by increasing the holding torque by adjusting the driving current according to the transitional load fluctuation. That is, the magnitude of the transitional load fluctuation can be reduced.

Figure 27:
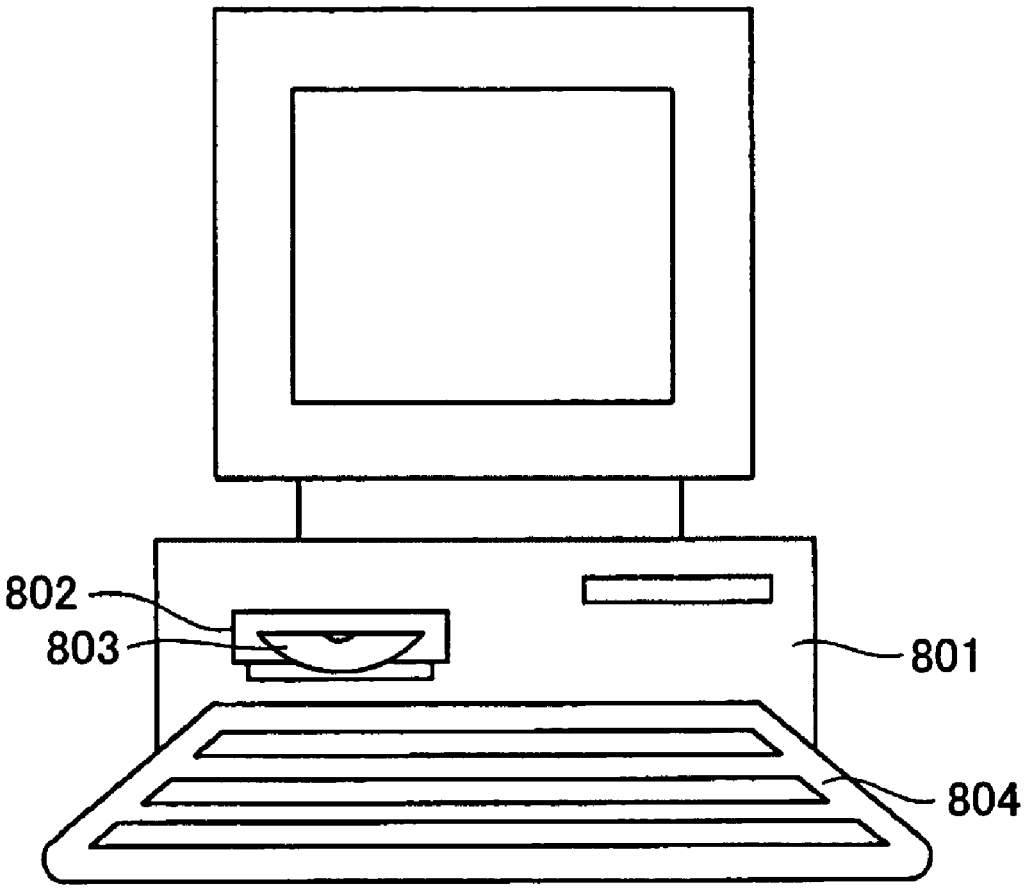
FIG. 27 is a schematic diagram of a personal computer that is an example of the computer used for performing a rotational drive control method.

FIG. 27 shows a personal computer 801 serving as an example of a computer used for controlling the driving of the rotating body of the present invention.

The personal computer 801 includes a recording medium 803, a drive 802 of the recording medium, and a keyboard 804.

The recording medium 803 stores a program for the personal computer 801 to execute for controlling and operating. The personal computer 801 executes the program for carrying out control according to the program stored in the recording medium 803. The program includes a control program for carrying out the rotational drive of the rotating body by the computer, a control program for controlling the photo conductor drum driving gear of the image formation apparatus by the computer, a control program for controlling the running object driving gear of the image reading apparatus by the computer, and a control program for controlling the imprint drum driving gear of the image formation apparatus by the computer.

Further, the present invention is not limited to these embodiments, but variations and modifications may be made without departing from the scope of the present invention.

The present application is based on Japanese Priority Application No. 2005-222076 filed on Jul. 29, 2005 with the Japanese Patent Office, the entire contents of which are hereby incorporated by reference.

According to the present invention, the following features are included in various of the embodiments.

In one feature of the imprinting apparatus, the driving current is increased before the transitional load fluctuation occurs, and decreased after the transitional load fluctuation finishes.

In one feature of the imprinting apparatus, raising and lowering the driving current are gradually performed in order to reduce an amount of a position gap that may be generated when imprinting images on the recording medium which reduced amount is less than a predetermined threshold defined in view of an allowable quality of image.

In one feature of the imprinting apparatus, the driving current is increased at a timing that is defined based on a time lapse from a resist roller sending out the recording medium.

In one feature of the imprinting apparatus, the driving current is increased before the transitional load fluctuation occurs, and decreased after the transitional load fluctuation finishes.

In one feature of the imprinting apparatus, raising and lowering the driving current are gradually performed in order to reduce an amount of a position gap that may be generated when imprinting images on the recording medium which reduced amount is less than a predetermined threshold defined in view of an allowable quality of image.

In one feature of the imprinting apparatus, increasing the driving current when the recording medium departs from the conveyance unit is performed at a timing defined based on a time lapse from when the recording medium is sent out from a resist roller, the time lapse being determined based on a time difference obtained using a conversion table for converting a length of the recording medium, information of which is contained in a printing instruction, to the time difference.

In one feature of the imprinting apparatus, the imprinting apparatus includes a detector for providing a detection signal when passage of the recording medium is detected such that increasing the driving current is performed at a timing based on a time lapse from when the detection signal is provided by the detector.

In one feature of the imprinting apparatus, two sets of the shock absorbing mechanisms are provided, one being for absorbing a shock in a rotational direction, and the other for absorbing a shock in a reverse direction of the rotational direction.

In one feature of the imprinting apparatus, the dumping mechanism includes a viscous material that is sealed in the housing.

In one feature of the imprinting apparatus, the dumping mechanism includes a buffer mechanism made of one of a dash pot and rubber, the buffer mechanism being arranged in parallel with the spring mechanism between the shock absorbing unit and the housing.

In one feature of the imprinting apparatus, the auxiliary mechanism is an elastic member that is provided between the flywheel and an axle to which the flywheel is arranged.

In one feature of the imprinting apparatus, the motor is an outer rotor type motor.

In one feature of the imprinting apparatus, the flywheel is arranged in one body with an outer rotor of the outer rotor type motor.

In one feature of the imprinting apparatus, the motor is an outer rotor type motor.

In one feature of the imprinting apparatus, the auxiliary mechanism is arranged in one body with an outer rotor of the outer rotor type motor.

In one feature of the imprinting apparatus, the motor is a stepping motor.

In one feature of the imprinting apparatus, a current supplied to each phase of the stepping motor is a pseudo sine wave current.

In one feature of the imprinting apparatus, the motor is an ultrasonic motor.

In one feature of the imprinting apparatus, the image supporting member is shaped like a belt wound around a driving roller and one or more follower rollers, an encoder is provided to at least one of the follower rollers, and an apparatus is provided for feeding back a measurement value of the encoder to the motor.

In one feature of the present invention, an image formation apparatus includes any one or more of the above imprinting apparatus features.

In one feature of the imprinting apparatus, the apparatus imprints an image onto a recording medium when the recording medium passes through a pressure-contacting nip. The apparatus includes a motor serving as a driving source, an image supporting member driven by the motor, and a pressure-contacting member that has at least a rotating body that contacts the image supporting member with pressure at the pressure-contacting nip, and further includes a shock relief mechanism for mitigating a shock due to a transitional load fluctuation causing a transitional torque fluctuation generated at one of the image supporting member and the rotating body due to the recording medium entering and leaving the pressure-contacting nip such that an angular fluctuation of the motor becomes less than a predetermined threshold defined in view of quality of image with reference to a position fluctuation of images at a peak value of the transitional torque fluctuation.

In one feature of the imprinting apparatus, the apparatus imprints an image onto a recording medium when the recording medium passes through a pressure-contacting nip. The apparatus includes a motor serving as a driving source, an image supporting member driven by the motor, and a pressure-contacting member that includes at least a rotating body that contacts the image supporting member with pressure at the pressure-contacting nip, and further includes a shock relief mechanism for mitigating a shock due to a transitional load fluctuation causing a transitional torque fluctuation generated at one of the image supporting member and the rotating body due to the recording medium leaving a conveyance unit for conveying the recording medium such that an angular fluctuation of the motor becomes less than a predetermined threshold defined in view of quality of image with reference to a position fluctuation of images at a peak value of the transitional torque fluctuation.

In one feature of the imprinting apparatus, the apparatus imprints an image onto a recording medium when the recording medium passes through a pressure-contacting nip. The apparatus includes a motor serving as a driving source, an image supporting member driven by the motor, and a pressure-contacting member that includes at least a rotating body that contacts the image supporting member with pressure at the pressure-contacting nip, and further includes a shock relief mechanism for mitigating a shock due to a transitional load fluctuation causing a transitional torque fluctuation generated at one of the image supporting member and the rotating body due to the recording medium entering a fixing unit downstream of the imprinting unit. As such, the image on the recording medium is fixed, such that an angular fluctuation of the motor becomes less than a predetermined threshold defined in view of quality of image with reference to a position fluctuation of images at a peak value of the transitional torque fluctuation.

In one feature of the imprinting apparatus, the apparatus imprints an image onto a recording medium when the recording medium passes through an imprint section. The apparatus includes a motor serving as a driving source, an image supporting member driven by the motor, and a recording medium conveyance belt driven by a rotating body for conveying the recording medium, the recording medium conveyance belt contacting the image supporting member with pressure at the imprint section, and further includes a shock relief mechanism for mitigating a shock due to a transitional load fluctuation causing a transitional torque fluctuation generated at one of the image supporting member and the rotating body due to the recording medium entering and leaving the imprint section such that an angular fluctuation of the motor becomes less than a predetermined threshold defined in view of quality of image with reference to a position fluctuation of images at a peak value of the transitional torque fluctuation.

In one feature of the imprinting apparatus, the apparatus imprints an image onto a recording medium when the recording medium passes through an imprint section. The apparatus includes a motor serving as a driving source, an image supporting member driven by the motor, and a recording medium conveyance belt driven by a rotating body for conveying the recording medium, the recording medium conveyance belt contacting the image supporting member with pressure at the imprint section, and further includes a shock relief mechanism for mitigating a shock due to a transitional load fluctuation causing a transitional torque fluctuation generated at one of the image supporting member and the rotating body by the recording medium leaving a conveyance unit for conveying the recording medium such that an angular fluctuation of the motor becomes less than a predetermined threshold defined in view of quality of image with reference to a position fluctuation of images at a peak value of the transitional torque fluctuation.

In one feature of the imprinting apparatus, the apparatus imprints an image onto a recording medium when the recording medium passes through an imprint section. The apparatus includes a motor serving as a driving source, an image supporting member driven by the motor, and a recording medium conveyance belt driven by a rotating body for conveying the recording medium, the recording medium conveyance belt contacting the image supporting member with pressure at the imprint section, and further includes a shock relief mechanism for mitigating a shock due to a transitional load fluctuation causing a transitional torque fluctuation generated at one of the image supporting member and the rotating body due to the recording medium entering a fixing unit in a downstream of the imprinting unit, wherein an image on the recording medium is fixed, such that an angle fluctuation of the motor becomes less than a predetermined threshold defined in view of quality of image with reference to a position fluctuation of images at a peak value of the transitional torque fluctuation.

In one feature of the imprinting apparatus, the shock relief mechanism is a shock absorbing mechanism that includes an inertial mass, a spring mechanism, and a dumping mechanism.

In one feature of the imprinting apparatus, the shock absorbing mechanism includes a housing that concentrically rotates in one body with one of the image supporting member and the rotating body, a contacting unit provided in the housing, a bearing for supporting an axle of the image supporting member and the rotating body, a shock absorbing unit including the inertial mass that can freely rotate, the shock absorbing unit being arranged on the bearing through a supporting member, and a spring supporting unit fixed to the housing, one end the spring supporting unit being fixed to the shock absorbing unit, and the other end being fixed to the spring mechanism that presses the shock absorbing unit to the contacting unit.

In one feature of the imprinting apparatus, two sets of the shock absorbing mechanisms are provided, one being for absorbing a shock in a rotational direction, and the other for absorbing a shock in a reverse direction of the rotational direction.

In one feature of the imprinting apparatus, the dumping mechanism includes a viscous material that is sealed in the housing.

In one feature of the imprinting apparatus, the dumping mechanism includes a buffer mechanism made of one of a dash pot and rubber, the buffer mechanism being arranged in parallel with the spring mechanism between the shock absorbing unit and the housing.

In one feature of the imprinting apparatus, the shock relief mechanism includes a flywheel member concentrically arranged with at least one of the image supporting member and the rotating body where a transitional load fluctuation causing the transitional torque fluctuation is generated, and an auxiliary mechanism for mitigating a difference between rotational speeds of the flywheel member and one of the image supporting member and the rotating body where the transitional torque fluctuation is generated.

In one feature of the imprinting apparatus, the shock relief mechanism includes a flywheel member that is concentrically arranged with one of the image supporting member and the rotating body where the transitional load fluctuation causing the transitional torque fluctuation is generated in addition to the shock absorbing mechanism.

In one feature of the imprinting apparatus, the shock relief mechanism includes an auxiliary mechanism for mitigating a difference between rotational speeds of the flywheel member and one of the image supporting member and the rotating body where the transitional torque fluctuation is generated.

In one feature of the imprinting apparatus, the auxiliary mechanism includes the flywheel and a rotating member that counters the flywheel, both being made of a magnetic material, and one having a permanent magnet attached to a side that counters the other.

In one feature of the imprinting apparatus, the auxiliary mechanism includes the flywheel that is shaped like a container, a rotating member that rotates in the container-shaped flywheel, and a viscous material that is filled up inside the container-shaped flywheel around the rotating member.

In one feature of the imprinting apparatus, the auxiliary mechanism is an elastic member that is provided between the flywheel and an axle to which the flywheel is arranged.

In one feature of the imprinting apparatus, the motor is an outer rotor type motor.

In one feature of the imprinting apparatus, the flywheel member is arranged in one body with an outer rotor of the outer rotor type motor.

In one feature of the imprinting apparatus, the motor is an outer rotor type motor.

In one feature of the imprinting apparatus, the flywheel member and the auxiliary mechanism are arranged in one body with an outer rotor of the outer rotor type motor.

In one feature of the imprinting apparatus, the motor is a stepping motor.

In one feature of the imprinting apparatus, a current supplied to each phase of the stepping motor is a pseudo sine wave current.

In one feature of the imprinting apparatus, the motor is an ultrasonic motor.

In one feature of the imprinting apparatus, the image supporting member is shaped like a belt wound around a driving roller and one or more follower rollers, an encoder is provided on at least one of the follower rollers, and an apparatus is provided for feeding back a measurement value of the encoder to the motor.

In one feature of the present invention, a image formation apparatus includes any one or more of the above described imprinting apparatus features.

In one feature of the imprinting apparatus, the apparatus imprints an image onto a recording medium when the recording medium passes contacts an image supporting member. The apparatus includes a motor serving as a driving source, the image supporting member driven by the motor, and a rotating body for conveying the recording medium. Further a driving current supplied to the motor is temporarily increased with reference to a driving current during usual rotation when a transitional load fluctuation causing a transitional torque fluctuation occurs at one of the image supporting member and the rotating body by the recording medium entering and leaving the rotating body such that an angular fluctuation of the motor becomes less than a predetermined threshold defined in view of quality of image with reference to a position fluctuation of images at a peak value of the transitional torque fluctuation.

In one feature of the imprinting apparatus, the apparatus imprints an image onto a recording medium when the recording medium passes contacting an image supporting member. The apparatus includes a motor serving as a driving source, the image supporting member driven by the motor, and a rotating body for conveying the recording medium, and further includes a shock relief mechanism for mitigating a shock due to a transitional load fluctuation causing a transitional torque fluctuation generated at one of the image supporting member and the rotating body by the recording medium entering and leaving the image supporting member such that an angular fluctuation of the motor becomes less than a predetermined threshold defined in view of quality of image with reference to a position fluctuation of images at a peak value of the transitional torque fluctuation.

What is claimed is:

1. An imprinting apparatus for imprinting an image onto a recording medium when the recording medium passes through a pressure-contacting nip, comprising:

a stepper motor serving as a driving source;

a pulse generating unit serving to control a frequency of a pulse signal driving the stepper motor;

an image supporting member driven by the stepper motor; and a pressure-contacting member that includes at least a rotating body that contacts the image supporting member with pressure at the pressure-contacting nip; wherein a driving current supplied to the stepper motor is temporarily increased with reference to a driving current during usual rotation when a first transitional load fluctuation causing a transitional torque fluctuation occurs at one of the image supporting member and the rotating body by the recording medium entering and the pressure-contacting nip and a second transitional load fluctuation causing a transitional torque fluctuation occurs at one of the image supporting member and the rotating body by the recording medium leaving the pressure-contacting nip such that an angular fluctuation of the motor becomes less than a predetermined threshold defined in view of quality of image with reference to a position fluctuation of images at a peak value of the transitional torque fluctuation, and the driving current is increased before the first transitional load fluctuation occurs, and the driving current is increased after said second transitional load fluctuation, and changes in the driving current before and after said load fluctuations are gradually performed in order to reduce an amount of a position gap generatable when imprinting images on the recording medium, where the reduced amount is less than a predetermined threshold defined in view of an allowable quality of image.

2. The imprinting apparatus as claimed in claim 1, wherein increasing the driving current when the recording medium enters the nip is performed at a timing that is defined based on a time lapse from a resist roller sending out the recording medium.

3. The imprinting apparatus as claimed in claim 2, wherein increasing the driving current when the recording medium departs the nip is performed at a timing determined based on a conversion table that converts a length of the recording medium provided by a printing instruction to a time difference.

4. The imprinting apparatus as claimed in claim 1, further comprising:

a detector for providing a detection signal when passage of the recording medium is detected; wherein increasing the driving current when the recording medium enters the nip is performed at a timing based on a time lapse from when the detection signal is provided by the detector.

5. The imprinting apparatus as claimed in claim 4, wherein increasing the driving current when the recording medium departs the nip is performed at a timing determined based on a time difference between the detector detecting a tip and an end of the recording medium.

6. The imprinting apparatus as claimed in claim 1, wherein: the pulse output by the pulse generating unit determines a driving speed of the stepper motor and a driver providing said driving current to said stepper motor.

7. The imprinting apparatus as claimed in claim 1, wherein: the stepper motor comprises a three phase motor.

8. The imprinting apparatus as claimed in claim 7, wherein: the pulse generating unit outputs respective pulses for each phase of the three phase motor.

9. The imprinting apparatus as claimed in claim 8, wherein: a timing of the respective pulses advances the stepping motor by one tooth pitch.

10. An imprinting apparatus for imprinting an image onto a recording medium when the recording medium passes through an imprint section, comprising:

a stepper motor serving as a driving source;

a pulse generating unit serving to control a frequency of a pulse signal driving the stepper motor an image supporting member driven by the stepper motor; and a recording medium conveyance belt driven by a rotating body for conveying a recording medium, the recording medium conveyance belt contacting the image supporting member with pressure at the imprint section; wherein a driving current supplied to the stepper motor is temporarily increased with reference to a driving current during usual rotation when a first transitional load fluctuation causing a transitional torque fluctuation occurs at one of the image supporting member and the recording medium conveyance belt by the recording medium entering the imprint section and a second transitional load fluctuation causing a transitional torque fluctuation occurs at one of the image supporting member and the rotating body by the recording medium leaving the imprint section such that an angular fluctuation of the motor becomes less than a predetermined threshold defined in view of quality of image with reference to a position fluctuation of images at a peak value of the transitional torque fluctuation, and the driving current is increased before the first transitional load fluctuation occurs, and the driving current is increased after said second transitional load fluctuation, and changes in the driving current before and after said load fluctuations are gradually performed in order to reduce an amount of a position gap generatable when imprinting images on the recording medium, where the reduced amount is less than a predetermined threshold defined in view of an allowable quality of image.

* * * * *